US010823104B2

(12) United States Patent
Kusakabe et al.

(10) Patent No.: US 10,823,104 B2
(45) Date of Patent: Nov. 3, 2020

(54) DRIVE DEVICE FOR FUEL INJECTION DEVICES

(71) Applicant: HITACHI AUTOMOTIVE SYSTEMS, LTD., Hitachinaka-shi, Ibaraki (JP)

(72) Inventors: Ryo Kusakabe, Tokyo (JP); Motoyuki Abe, Tokyo (JP); Toshihiro Aono, Tokyo (JP); Takashi Okamoto, Tokyo (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 0 days.

(21) Appl. No.: 16/505,082

(22) Filed: Jul. 8, 2019

(65) Prior Publication Data

US 2019/0331052 A1 Oct. 31, 2019

Related U.S. Application Data

(63) Continuation of application No. 15/314,981, filed as application No. PCT/JP2015/062168 on Apr. 22, 2015, now Pat. No. 10,371,084.

(30) Foreign Application Priority Data

May 30, 2014 (JP) ..... 2014-111877

(51) Int. Cl.
*F02D 41/20* (2006.01)
*F02D 41/32* (2006.01)
(Continued)

(52) U.S. Cl.
CPC ..... *F02D 41/32* (2013.01); *F02D 41/20* (2013.01); *F02D 41/34* (2013.01); *F02D 41/36* (2013.01);
(Continued)

(58) Field of Classification Search
CPC ..... F02D 41/32; F02D 41/3809; F02D 41/20; F02D 41/34; F02D 41/36; F02D 45/00;
(Continued)

(56) References Cited

U.S. PATENT DOCUMENTS 5,708,202 A * 1/1998 Augustin ..... F02D 41/221 73/114.43
6,463,910 B2 * 10/2002 Nishiyama ..... F02D 41/401 123/447
(Continued)

FOREIGN PATENT DOCUMENTS

JP 10-009033 A 1/1998
JP 11-229938 A 8/1999
(Continued)

OTHER PUBLICATIONS

International Search Report, PCT/JP2015/062168, dated Jul. 21, 2015, 2 pgs.
(Continued)

*Primary Examiner* — David Hamaoui
(74) *Attorney, Agent, or Firm* — Volpe Koenig

(57) ABSTRACT

The purpose of the present invention is to detect variations between the quantities of fuel injected into cylinders by fuel injection devices and correct the fuel injection quantity variation while minimizing the computational load on a drive device and the level of performance required of a pressure sensor. A drive device for fuel injection devices according to the present invention performs control wherein movable valves are driven so that predetermined quantities of fuel are injected by applying, for the duration of a set energization time, a current that will reach an energization current to solenoids of a plurality of fuel injection devices which open/close fuel flow paths. The drive device is characterized in that the set energization time or energization current is corrected on the basis of a pressure detection value
(Continued)

from a pressure sensor that is attached to a fuel supply pipe disposed upstream of the plurality of fuel injection devices.

2 Claims, 13 Drawing Sheets

(51) Int. Cl.
*F02D 41/34* (2006.01)
*F02D 41/36* (2006.01)
*F02D 45/00* (2006.01)
*F02D 41/38* (2006.01)

(52) U.S. Cl.
CPC ..... *F02D 41/3809* (2013.01); *F02D 45/00* (2013.01); *F02D 2041/2034* (2013.01); *F02D 2041/2055* (2013.01); *F02D 2200/0602* (2013.01); *F02D 2200/0614* (2013.01); *F02D 2200/0618* (2013.01)

(58) Field of Classification Search
CPC ..... F02D 2041/2055; F02D 2200/0602; F02D 2200/0614; F02D 2200/0618; F02D 2041/2034
See application file for complete search history.

(56) References Cited

U.S. PATENT DOCUMENTS 6,732,715 B2 * 5/2004 Fallahi ..... F02D 41/20 123/478
7,188,608 B2 * 3/2007 Wilson ..... F02D 41/064 123/456
8,554,448 B2 * 10/2013 Imai ..... F02D 41/3863 123/447
8,566,005 B2 * 10/2013 Yamada ..... F02D 41/401 123/447
10,385,814 B2 * 8/2019 Sgatti ..... F02D 41/2467
10,428,758 B2 * 10/2019 Imai ..... F02D 41/40
2008/0228374 A1 * 9/2008 Ishizuka ..... G01M 15/09 701/103
2009/0326788 A1 * 12/2009 Yuasa ..... F02D 41/3809 701/104
2013/0073188 A1 3/2013 Rosel
2017/0248086 A1 * 8/2017 Hashimoto ..... F02D 37/02
2020/0032732 A1 * 1/2020 Petitjean, Jr. ..... F02D 41/40

FOREIGN PATENT DOCUMENTS

JP 11-315768 A 11/1999
JP 2000-282928 A 10/2000
JP 2003-278586 A 10/2003
JP 2009-097385 A 5/2009
JP 2010-043614 A 2/2010
JP 2011-007203 A 1/2011
WO 2011/151128 A1 12/2011
WO 2013/191267 A1 5/2016

OTHER PUBLICATIONS

Japanese Office Action dated Apr. 16, 2019 for the Japanese Patent Application No. 2018-140856.

* cited by examiner

FIRST-ORDER APPROXIMATION

| DISPLACEMENT ⟷ | MAGNETIC FLUX | VOLTAGE |
|---|---|---|
| $x$ | $\phi$ | — |
| $\frac{dx}{dt}$ | $\frac{d\phi}{dt}$ | $V$ |
| $\frac{d^2x}{dt^2}$ | $\frac{d^2\phi}{dt^2}$ | $\frac{dV}{dt}$ |

DRIVE DEVICE FOR FUEL INJECTION DEVICES

CROSS-REFERENCE TO RELATED PATENT APPLICATION

This U.S. non-provisional patent application is a continuation of U.S. patent application Ser. No. 15/314,981 filed on Nov. 30, 2016, which claims priority under 35 U.S.C. § 119 of Japanese Patent Application No. 2014-111877, filed on May 30, 2014, and International Application No. PCT/JP2015/062168, filed on Apr. 22, 2015, the whole contents of which are hereby incorporated by reference.

DESCRIPTION

Technical Field

The present invention relates to a drive device that drives a fuel injection device of an internal combustion engine.

Background Art

Recently, there is a demand for improvement of fuel economy (fuel consumption rate) in internal combustion engines from a viewpoint of reinforced control on emission of a carbon dioxide gas and concerns on fossil fuel depletion. Thus, there have been attempts to achieve the improvement of the fuel economy by reducing various types of losses in the internal combustion engine. In general, it is possible to decrease the output required for operation of an engine when the losses are reduced, and thus, it is possible to decrease the minimum output of the internal combustion engine. In such an internal combustion engine, it is necessary to control and supply fuel to the small quantities of fuel corresponding to the minimum output.

In addition, a downsized engine, which acquires size reduction by reducing displacement and obtains output using a supercharger, has drawn attentions in recent years. In the downsized engine, it is possible to reduce a pumping loss or friction by reducing the displacement, and thus, it is possible to improve the fuel economy. Meanwhile, it is possible to obtain the sufficient output using the supercharger and to improve the fuel economy by minimizing a decrease in compression ratio accompanying the supercharging through an intake air cooling effect by performing in-cylinder direct injection. In particular, a fuel injection device using this downsized engine needs to be capable of injecting fuel over a wide range from the minimum injection quantity corresponding to the minimum output due to the low displacement and to the maximum injection quantity corresponding to the maximum output that is obtained by the supercharging, and there is a demand for expansion of a control range of the injection quantity.

In addition, there is a demand for minimizing of the total quantity of particulate matter (PM) during mode traveling and the particulate number (PN) as the number thereof of in engine along with reinforcement of the emission control, and there is a demand for a fuel injection device which is capable of controlling a minute injection quantity. As a means for minimizing the generation of particulate matter, it is effective to perform injection by dividing spray during one combustion stroke into a plurality of times (hereinafter, referred to as divided injection). It is possible to suppress adhesion of fuel onto a piston and a cylinder wall surface by performing the divided injection, and thus, the injected fuel is easily vaporized, and it is possible to minimize the total quantity of the particulate matter and the particulate number as the number thereof. In an engine that performs divided injection, it is necessary to divide fuel, which has been injected at one time so far, to be injected a plurality of times, and thus, it is necessary to control the minute injection quantity in the fuel injection device as compared to the related art.

In general, the injection quantity of the fuel injection device is controlled by a pulse width of an injection pulse to be output from an engine control unit (ECU). The injection quantity increases as the injection pulse width increases, and the fuel injection quantity decreases as the injection pulse width decreases, and the relationship thereof is substantially linear. However, when the injection pulse width decreases, a region with an intermediate opening where a movable element and a fixed core does not collide with each other, that is, a valve body does not reach the maximum opening is formed. Even if the same injection pulse is supplied to each fuel injection devices of cylinders, the displacement quantity of the valve body of the fuel injection device greatly differs depending on an individual difference caused by dimensional tolerance of the fuel injection device or influence due to deterioration with age in the region with the intermediate opening, and thus, individual variations of the injection quantity are generated. In addition, even when the quantity of displacement of the valve body is equal, the individual variations of the injection quantity are generated due to the influence of the dimensional tolerance such as an injection hole diameter of an injection hole to inject the fuel. Since the required injection quantity is small in the region with the intermediate opening, the influence that the individual variations of the injection quantity on a degree of homogeneity of air-fuel mixture becomes more significant, and there is a problem in using the region with the intermediate opening from a viewpoint of stability of combustion.

In addition, minimizing of the fuel injection quantity variation in the region with the intermediate opening where the injection pulse is small and the valve body does not reach the maximum opening and accurate control of the injection quantity are required in order to significantly reduce the minimum injection quantity.

A technique, which is capable of detecting a fuel injection quantity variation, generated due to the dimensional tolerance of the fuel injection device, such as an individual difference of time between stop of the injection pulse and arrival of the movable element at a valve closing position, for each fuel injection device of each cylinder and correcting the injection quantity for each individual device, is required in order to reduce the fuel injection quantity variation at the intermediate opening. There is a method disclosed in PTL 1 as a means for detecting an operation timing of a valve body of a fuel injection device which is the main factor of a fuel injection quantity variation. PTL 1 discloses the method of detecting a valve closing finish timing of the valve body by comparing an induced electromotive voltage generated at a voltage of a coil and a reference voltage curve, and determining a valve closing time of an injection valve based on the detection information.

In addition, there is a case in which deposits adhere to the injection hole to inject the fuel, and the injection quantity changes due to the influence of the dimensional tolerance of the injection hole diameter of the fuel injection device or the deterioration with age. Such deposits may be generated when soot generated by combustion enters the injection hole or when the fuel is deposited around the injection hole and becomes the deposits. In this case, the fuel injection quantity variation is generated even when a time-series profile of the valve body of the fuel injection device of each cylinder is the same, that is, each valve closing finish timing is the same. For example, PTL 2 discloses a method of detecting a fluctuating waveform caused by fuel injection by detecting a time-series profile of a pressure sensor in an ECU using a pressure sensor arranged on a side close to an injection hole with respect to a common rail, and estimating an injection quantity based on the detected waveform.

CITATION LIST

Patent Literature

PTL 1: WO 2011/151128
PTL 2: JP 2011-7203 A

SUMMARY OF INVENTION

Technical Problem

The fuel injection device causes the valve body to perform an open/close operation by supplying a drive current to a solenoid (coil) or stopping the supply, and there is a time lag between start of the supply of the drive current and arrival of the valve body at the maximum opening, and there are constraints on the minimum injection quantity that can be controlled if the injection quantity is controlled under a condition that the valve body performs a valve closing operation after reaching the maximum opening. Therefore, it is necessary to be able to accurately control the injection quantity under the condition of the intermediate opening where the valve body does not reach the maximum opening in order to control the minute injection quantity. However, the operation of the valve body becomes uncertain that is not regulated by a physical stopper in the state with the intermediate opening, and thus, an injection time during which the valve is opened, obtained by counting time between a point in time when the valve body is closed and a point in time when the valve body starts a valve opening operation, with a timing when the injection pulse for driving of the fuel injection device is turned on as a starting point, varies according to the fuel injection devices of the respective cylinders.

In addition, the flow rate to be injected from the fuel injection device is determined by a gross sectional area of injection holes and an integrated area of the quantities of displacement of the valve body of the injection time during which the valve body is opened. Thus, it is necessary to match the injection time during which the valve body is displaced for each fuel injection device of each cylinder, and to correct each individual variation of the gross sectional area of the injection holes and the fuel injection quantity variation accompanying deterioration in durability in order to reduce the variations between the quantities of fuel injected into the cylinders by the fuel injection devices.

As a means for correcting the fuel injection quantity variation accompanying the individual difference of the injection hole, PTL 2 describes a fuel injection state detection device and a method of attaching a pressure sensor, configured for detection of fuel pressure, to each fuel injection device of each cylinder, detecting pressure drop accompanying fuel injection, and estimating an injection quantity using time-series data of the detection value thereof. However, it is necessary to use the pressure sensor with high responsiveness and cause a value output from the pressure sensor to be received by a drive device at high time resolution in order to estimate the fuel injection quantity variation only by the pressure sensor. Thus, an increase in cost of the pressure sensor and minimizing of a computational load on the drive device become problems.

An object of the present invention is to detect variations between the quantities of fuel injected into cylinders by fuel injection devices and correct the fuel injection quantity variation while minimizing a computational load on a drive device and the level of performance required of a pressure sensor.

Solution to Problem

In order to solve the above-described problems a drive device for fuel injection devices according to the present invention performs control in which movable valves are driven so that predetermined quantities of fuel are injected by applying, for the duration of a set energization time, a current that will reach an energization current to solenoids of a plurality of fuel injection devices which open/close fuel flow paths. The drive device is characterized in that the set energization time or energization current is corrected on the basis of a pressure detection value from a pressure sensor that is attached to a fuel supply pipe disposed upstream of the plurality of fuel injection devices or any one of the plurality of fuel injection devices.

Advantageous Effects of Invention

According to the present invention, it is possible to provide the drive device that is capable of estimating the variations between the quantities of the fuel injected into the cylinders by the fuel injection devices and reducing the controllable minimum injection quantity while minimizing the load on the drive device. Other configurations, operations, and effects of the present invention other than those described above will be described in detail in the following embodiments.

DESCRIPTION OF EMBODIMENTS

Figure 1:
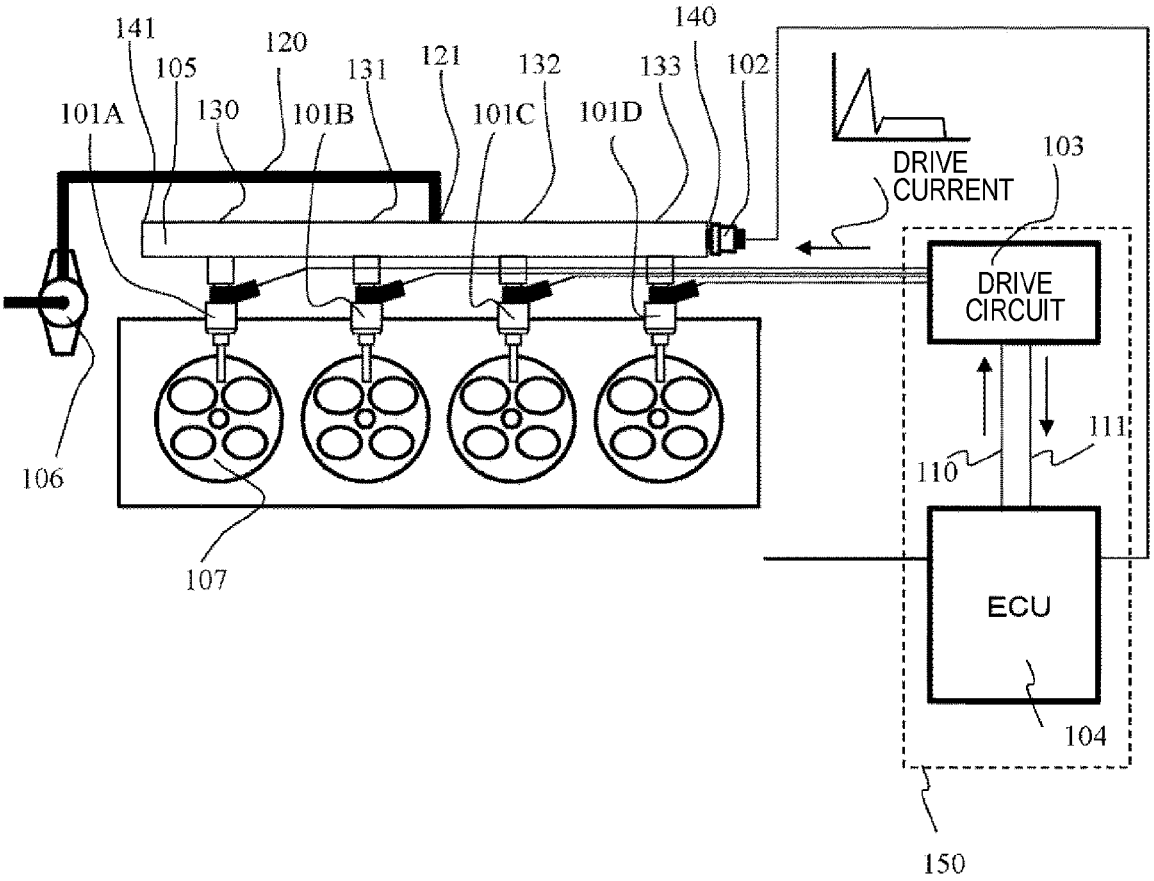
FIG. 1 is a schematic view of a case in which a fuel injection device, a pressure sensor, a drive device, and an ECU (engine control unit) according to first to four embodiments are mounted to an in-cylinder direct injection engine.

Hereinafter, embodiments of the present invention will be described with reference to the drawings.

First Embodiment

First, a description will be given regarding a fuel injection system which is configured of a fuel injection device, a pressure sensor, and a drive device according to the present invention with reference to FIGS. 1 to 7. First, a configuration of the fuel injection system will be described with reference to FIG. 1. Fuel injection devices 101A to 101D are installed in respective cylinders so that each fuel spray from injections holds thereof is directly injected to each combustion chamber 107. Fuel is boosted by a fuel pump 106, sent to a fuel supply pipe 105, and delivered to the fuel injection devices 101A to 101D. Although the fuel pressure changes depending on a balance between a flow rate of fuel ejected by the fuel pump 106 and an injection quantity of fuel injected into each combustion chamber by the fuel injection device provided in each cylinder, an ejection amount from the fuel pump 106 is controlled using a predetermined pressure as a target value based on information from a pressure sensor 102.

The injection of fuel using the fuel injection devices 101A to 101D is controlled according to an injection pulse width sent from an engine control unit (ECU) 104, this injection pulse is input to a drive circuit 103 of the fuel injection device, and the drive circuit 103 is configured determine a drive current waveform based on a command from the ECU 104 and to supply the drive current waveform to the fuel injection devices 101A to 101D for a time based on the injection pulse. Incidentally, the drive circuit 103 is mounted as a part or a substrate which is integrated with the ECU 104 in some cases. A device in which the drive circuit 104 and the ECU 104 are integrated will be referred to as a drive device 150.

Figure 2:
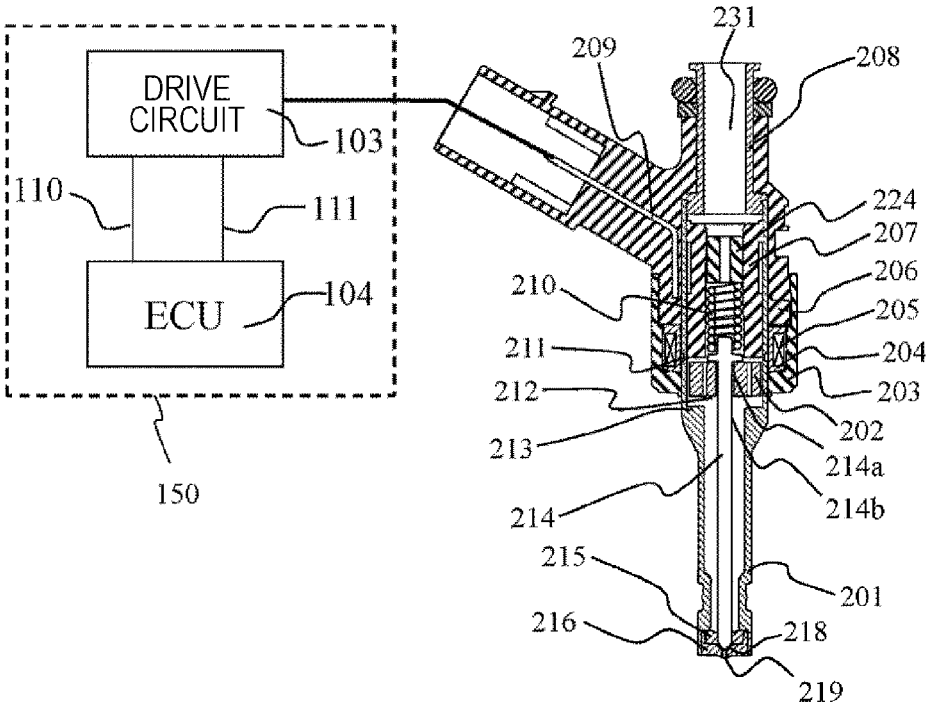
FIG. 2 is a vertical cross-sectional view of the fuel injection device according to the first to four embodiments of the present invention, and a diagram illustrating a configuration of the drive circuit and the engine control unit (ECU) which are connected to the fuel injection device.

Next, each configuration and basic operation of the fuel injection device and the drive device therefor will be described. FIG. 2 is a vertical cross-sectional view of the fuel injection device and a diagram illustrating an example of a configuration of the drive circuit 103 for drive of the fuel injection device and the ECU 104. Incidentally, the equivalent parts as those in FIG. 1 will be denoted by the same reference signs in FIG. 2. The ECU 104 receives a signal indicating an engine state from various sensors and performs computation of the injection pulse width, configured for control of the injection quantity to be injected from the fuel injection device according to an operating condition of an internal combustion engine, and an injection timing. In addition, the ECU 104 is provided with an A/D converter and an I/O port which are configured for receiving the signal from the various sensors. The injection pulse output from the ECU 104 is input to the drive circuit 103 of the fuel injection device via a signal line 110. The drive circuit 103 controls a voltage to be applied to a solenoid 205 and supplies current. The ECU 104 performs communication with the drive circuit 103 via a communication line 111 and can switch the drive current generated by the drive circuit 103 according to the pressure of fuel supplied to the fuel injection device or the operating condition and change setting values of the current and time.

Figure 3:
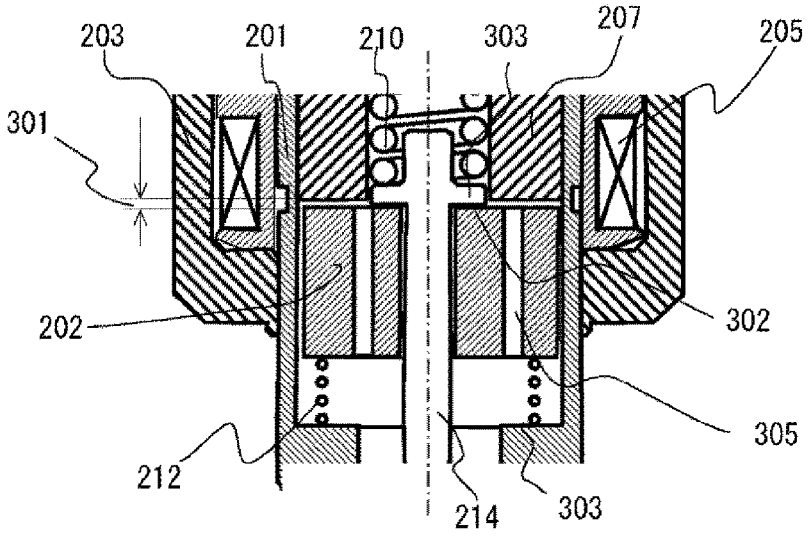
FIG. 3 is a diagram illustrating an enlarged cross-sectional view of a drive unit structure of the fuel injection device according to the first to four embodiments of the present invention.

Next, the configuration and operation of the fuel injection device will be described with reference to the vertical cross section of the fuel injection device in FIG. 2 and a cross-sectional view of FIG. 3 in which the vicinity of a movable element 202 and a valve body 214 are enlarged. Incidentally, the equivalent parts as those in FIG. 2 will be denoted by the same reference signs in FIG. 3. The fuel injection device illustrated in FIGS. 2 and 3 is a normally closed electromagnetic valve (electromagnetic fuel injection device), and the valve body 214 is biased in a valve closing direction by a spring 210 as a first spring in a non-energized state of a solenoid 205, and the valve body 214 is in close contact with a valve seat 218 to form a valve closing state. In the valve closing state, a force which is generated by a return spring 212 as a second spring in a valve opening direction, acts on the movable element 202. At this time, a force generated by the spring 210 and acting on the valve body 214 is larger than the force generated by the return spring 212, and thus, an end face 302 of the movable element 202 is in contact with the valve body 214, and the movable element 202 comes to rest. In addition, the valve body 214 and the movable element 202 are configured to be relatively displaceable and are contained in a nozzle holder 201. In addition, the nozzle holder 201 has an end face 303 serving as a spring seat of the return spring 212. The force generated by the spring 210 is adjusted at the time of assembly by a pushing amount of a spring clamp 224 which is fixed to an inner diameter of a fixed core 207.

In addition, a magnetic circuit is configured of the fixed core 207, the movable element 202, the nozzle holder 201, and a housing 203 in the fuel injection device, and an air gap is provided between the movable element 202 and the fixed core 207. A magnetic throttle 211 is formed in a part of the nozzle holder 201 which corresponds to the air gap between the movable element 202 and the fixed core 207. The solenoid 205 is attached at an outer circumferential side of the nozzle holder 201 in the state of being wound around a bobbin 204. A rod guide 215 is provided in the vicinity of a tip end of the valve body 214 on the valve seat 218 side so as to be fixed to the nozzle holder 201. A motion of the valve body 214 in a valve axial direction is guided by two sliding portions of a spring pedestal 207 of the valve body 214 and the rod guide 215. An orifice cup 216 in which the valve seat 218 and a fuel injection hole 219 are formed is fixed to the tip end of the nozzle holder 201 so as to seal an internal space (fuel passage) provided between the movable element 202 and the valve body 214 from the outside.

The fuel to be supplied to the fuel injection device is supplied from a rail pipe 105 provided upstream of the fuel injection device and passes through a first fuel passage hole 231 to flow up to a tip end of the valve body 214, and the fuel is sealed by a seat portion, formed at an end of the valve body 214 on the valve seat 218 side, and the valve seat 218. When the valve is closed, a differential pressure is generated due to fuel pressure between an upper side and a lower side of the valve body 214, and the valve body 114 is pressed in the valve closing direction by the differential pressure, obtained by multiplying the fuel pressure by a pressure receiving area of a seat inside diameter in a valve seat position, and the load of the spring 210. When the current is supplied to the solenoid 205 in the valve closing state, a magnetic field is generated in the magnetic circuit, a magnetic flux passes between the fixed core 207 and the movable element 202, and a magnetic suction force acts on the movable element 202. The movable element 202 starts to be displaced in the direction of the fixed core 207 at a timing when the magnetic suction force acting on the movable element 202 exceeds the loads caused by the differential pressure and the set spring 210.

After the valve body 214 starts a valve opening operation, the movable element 202 moves to the position of the fixed core 207, and the movable element 202 collides with the fixed core 207. After this collision between the movable element 202 and the fixed core 207, the movable element 202 operates to rebound by receiving a reaction force from the fixed core 207, but the movable element 202 is sucked by the fixed core 207 by the magnetic suction force acting on the movable element 202 and eventually stops. At this time, the force acts on the movable element 202 in the direction of the fixed core 207 due to the return spring 212, and thus, the time required for the rebound to converge can be shortened. The time when the gap between the movable element 202 and the fixed core 207 becomes large is shortened with the a smaller rebound operation, and a stable operation can be performed for a smaller injection pulse width.

The movable element 202 and the valve body 202 having finished the valve opening operation as described above come to rest in a valve opening state. In the valve opening state, there is a gap between the valve body 202 and the valve seat 218 and the fuel is injected from the injection hole 219. The fuel flows downstream by passing through a center hole provided in the fixed core 207 and a lower fuel passage hole 305 provided in the movable element 202.

When the energization of the solenoid 205 is cut off, the magnetic flux generated in the magnetic circuit disappears and the magnetic suction force also disappears. When the magnetic suction force acting on the movable element 202 disappears, the movable element 202 and the valve body 214 are pushed back to the valve closing position in contact with the valve seat 218 by the load of the spring 210 and the differential pressure.

In addition, when the valve body 214 is closed from the valve opening state, the valve body 214 is in contact with the valve seat 218, and then, the movable element 202 is separated from the valve body 214 and the movable element 202 and moves in the valve closing direction and returns to an initial position in the valve closing state by the return spring 212 after taking a motion for a certain time. As the movable element 202 separates from the valve body 214 at the moment when the valve body 214 finishes the valve opening, the mass of a movable member at the moment when the valve body 214 collides with the valve seat 218 can be reduced by the amount corresponding to the mass of the movable element 202, and thus, collision energy at the time of collision with the valve seat 218 can be decreased, and the bound of the valve body 214 generated when the valve body 214 collides with the valve seat 218 can be inhibited.

In the fuel injection device according to the present embodiment, the valve body 214 and the movable element 202 achieve an effect of inhibiting the bound of the movable element 202 with respect to the fixed core 207 and the bound of the valve body 214 with respect to the valve seat 218 by causing a relative displacement in a very short period of time at the moment when the movable element 202 collides with the fixed core 207 during valve opening and at the moment when the valve body 214 collides against the valve seat 218 during the valve closing.

Next, a description will be given regarding relationships among an injection pulse output from the ECU 104, a drive voltage at both terminal ends of the solenoid 205 of the fuel injection device, a drive current (exciting current) and a displacement quantity (valve body behavior) of the valve body 214 of the fuel injection device (FIG. 4), and a relationship between the injection pulse and a fuel injection quantity (FIG. 5) according to the present invention.

When an injection pulse is input to the drive circuit 103, the drive circuit 103 applies a high voltage 401 to the solenoid 205 from a high voltage source stepped up to a voltage higher than a battery voltage to start the supply of current to the solenoid 205. When the current value reaches a peak current value $I_{peak}$ set in advance for the ECU 104, the application of the high voltage 401 is stopped. Thereafter, the voltage value to be applied is set to 0 V or lower to decrease the current value like a current 402. When the current value becomes lower than a predetermined current value 404, the drive circuit 103 applies a battery voltage VB by switching and performs control so that a predetermined current 403 is held.

The fuel injection device is driven according to the above-described profile of the supplied current. The movable element 202 and the valve body 214 start to be displaced at a timing $t_{41}$ between the application of the high voltage 401 and the arrival at the peak current value $I_{peak}$, and thereafter, the movable element 202 and the valve body 214 reaches the maximum opening. The movable element 202 collides with the fixed core 207 at the timing when the movable element 202 reaches the maximum opening, and the movable element 202 performs the bound operation against the individual core 207. Since the valve body 214 is configured to be relatively displaceable with respect to the movable element 202, the valve body 214 is separated from the movable element 202, and the displacement of the valve body 214 overshoots exceeding the maximum opening. Thereafter, the movable element 202 comes to rest at the position with the predetermined maximum opening due to the magnetic suction force generated by the holding current 403 and the force of return spring 212 in the valve opening direction, and further, the valve body 214 seats on the movable element 202 and comes to rest at the position with the maximum opening, thereby forming valve opening state.

In the case of a fuel injection device having a movable valve in which the valve body 214 and the movable element 202 are integrated, the displacement quantity of the valve body 214 does not increase beyond the maximum opening and displacement quantities of the movable element 202 and the valve body 214 after reaching the maximum opening become equal.

Figure 5:
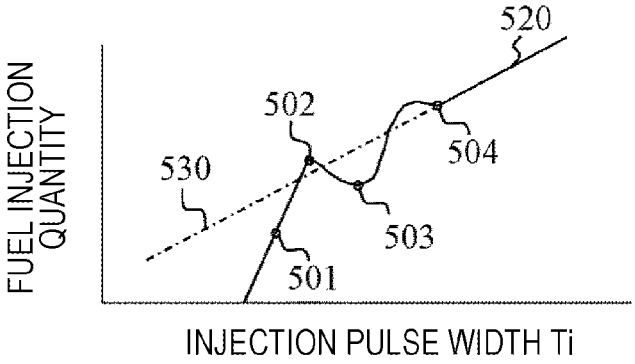
FIG. 5 is a diagram illustrating a relationship between an injection pulse width Ti to be output from the ECU of FIG. 4 and a fuel injection quantity.

Next, a relationship between an injection pulse width Ti and the fuel injection quantity will be described with reference to FIG. 5. Under a condition that the injection pulse width Ti does not reach a certain time, a force in the valve opening direction, which is a total force obtained by the magnetic suction force acting on the movable element 202 and the return spring 212, does not exceed a force in the valve closing direction, which is a total force obtained by the set spring 210 acting on the valve body 214 and the fuel pressure, and thus, the valve body 214 is not opened and no fuel is injected. Although the valve body 214 is separated from the valve seat 218 and starts to be displaced under a condition like a point 501 where the injection pulse width Ti is short, the valve closing is started before the valve body 214 reaches the maximum opening, and thus, the injection quantity decreases less than that in the case of an alternate long and short dash line 530 extrapolated from a linear region 520.

In addition, the valve closing is started immediately before reaching the maximum opening with an injection pulse width at a point 502, and a trajectory according to the time profile of the valve body 214 becomes a parabolic motion. Under this condition, kinetic energy of the valve body 214 in the valve opening direction is large, and further, the magnetic suction force acting on the movable element 202 is large, and thus, a ratio of the time required for the valve closing increases, and the injection quantity increases more than that in the case of the alternate long and short dash line 530. With an injection pulse at a point 503, the valve closing is started at the timing when a bound amount of the movable element 202 after reaching the maximum opening becomes the largest.

At this time, a repulsive force at the time of collision between the movable element 202 and the fixed core 207 acts on the movable element 202, and thus, a valve closing lag time between turn-off of the injection pulse and the closing of the valve body 214 decreases, and the injection quantity decreases less than that in the case of the alternate long and short dash line 530. The valve closing is started at a timing $t_{44}$ immediately after each bound of the movable element 202 and the valve body 214 converges with an injection pulse width at a point 504 Under a condition that the injection pulse width Ti larger than that at the point 504, the valve closing lag time increases substantially linearly in accordance with an increase of the injection pulse width Ti, and thus, the injection quantity of the fuel increases linearly. In a region between the start of fuel injection and the pulse width Ti indicated by the point 504, the injection quantity is likely to vary because the valve body 214 does not reach the maximum opening or the bound of the valve body 214 is unstable even when the valve body 214 reaches the maximum opening.

Figure 4:
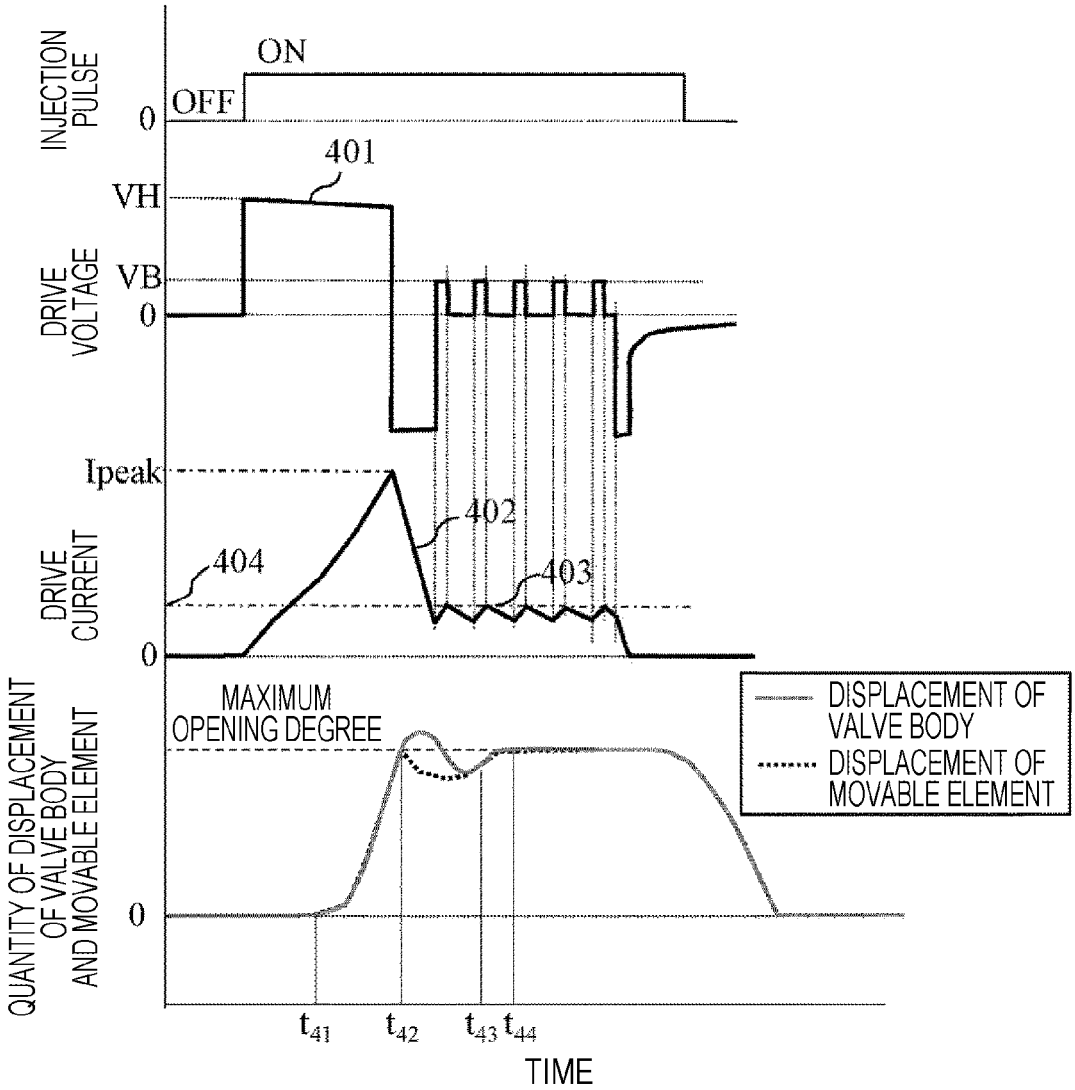
FIG. 4 is a diagram illustrating relationships among a general injection pulse to drive the fuel injection device, each timing of a drive voltage and a drive current to be supplied to the fuel injection device, and a valve body displacement quantity and time.

It is necessary to minimize a fuel injection quantity variation at the intermediate opening, smaller than the injection pulse width Ti at the point 502, where the valve body 214 does not reach the maximum opening in order to significantly decrease the minimum injection quantity that can be controlled. With a general drive current waveform as illustrated in FIG. 4, the bound of the valve body 214 generated by the collision between the movable element 202 and the fixed core 207 is large, and nonlinearity is generated in the region with the short injection pulse width Ti up to the point 504 as the valve closing is started in the middle of the bound of the valve body 214, and this nonlinearity leads to deterioration of the minimum injection quantity. Therefore, it is necessary to reduce the bound of the valve body 214 generated after reaching the maximum opening in order to improve the nonlinearity of injection quantity characteristics under the condition that the valve body 214 reaches the maximum opening. In addition, the timing when the movable element 202 and the fixed core 207 come into contact differs for each fuel injection device and speed of the collision between the movable element 202 and the fixed core 207 varies because of changes in behavior of the valve body 214 due to dimensional tolerance, and thus, the bound of the valve body 114 varies for individual fuel injection devices, and individual variations of the injection quantity increase.

Figure 6:
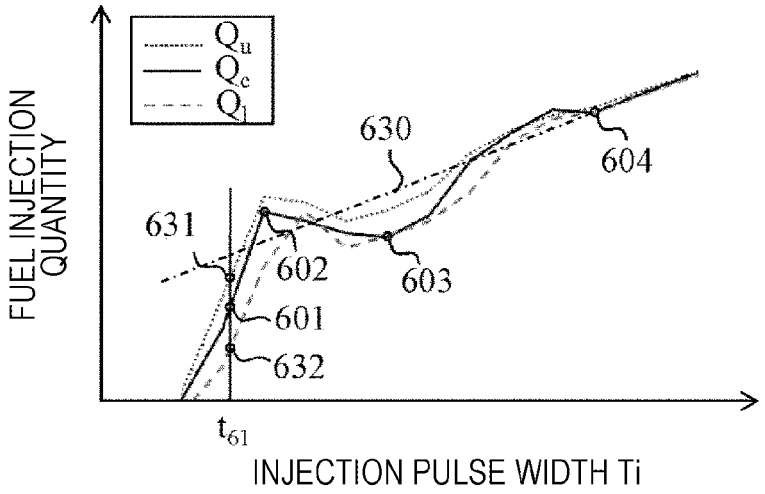
FIG. 6 is a diagram illustrating a relationship between the injection pulse width Ti and the fuel injection quantity in a general fuel injection device having an individual variation in injection quantity characteristics.
Figure 7:
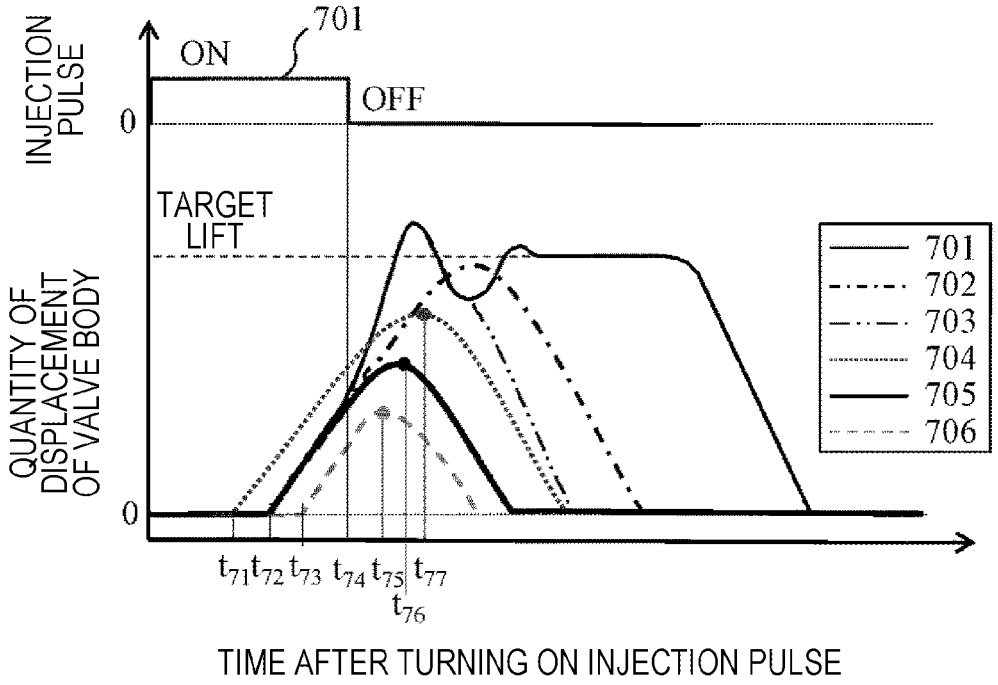
FIG. 7 is a diagram illustrating a valve behavior at each of points 601, 602, 603, 631 and 632 in FIG. 6.

Next, a description will be given regarding a relationship between individual variations of the injection quantity with each injection pulse width Ti and the displacement quantity of the valve body 214 with reference to FIGS. 6 and 7. FIG. 6 is a diagram illustrating the relationship between the injection pulse width Ti and individual variations of the injection quantity caused by component tolerance of the fuel injection device. FIG. 7 is a diagram illustrating a relationship among the injection pulse width under a condition that the injection pulse width becomes $t_{61}$ in FIG. 6, the displacement quantity of the valve body 214 of each fuel injection device, and time.

Individual variations of the injection quantity are caused by the influence of each dimensional tolerance of fuel injection devices, deterioration with age, changes of environmental conditions such as a change of a current value to be supplied to the solenoid 205 caused by individual variations of the fuel pressure supplied to the fuel injection device, a battery voltage source of the drive device, and a voltage value of a step-up voltage source, and a change of a resistance value of the solenoid 205 depending on a temperature change. The injection quantity of fuel to be injected from the injection hole 219 of the fuel injection device is determined by three factors including a gross sectional area of a plurality of injection holes determined depending on a diameter of the injection hole 219, a pressure loss between a seat portion of the valve body 214 and an injection hole entrance, and a cross-sectional area of a fuel flow path between the valve body 214 and the valve seat 218 in a fuel seat portion determined by the displacement quantity of the valve body 214. FIG. 6 describes injection quantity characteristics of an individual Qu of a larger injection quantity and an individual Ql of a smaller injection quantity in relation to an individual Qc having a design median value of the injection quantity in a region with the small injection pulse width when a fixed fuel pressure is supplied to the fuel injection device.

A description will be given regarding the relationship between the injection quantity in each injection pulse width Ti of the individual Qc having the design median value of the injection quantity and the displacement quantity of the valve body 214 under a condition of an injection pulse width $t_{61}$. The injection pulse width Ti is turned off and the valve body 214 starts the valve closing before the valve body 214 reaches the maximum opening under a condition at a point 601 with a small injection pulse width Ti, and a trajectory of the valve body 214 is a parabolic motion as indicated by a solid line 705. Next, the displacement quantity of the valve body 214 is larger than that under the condition at the point 601 at a point 602 where the injection quantity is larger than that in the case of an alternate long and short dash line 630, extrapolated from a linear region where the relationship between the injection pulse width Ti and the injection quantity is substantially linear, and the valve closing is started immediately before the valve body 214 reaches the maximum opening, and a trajectory is a parabolic motion similarly to that at the point 601.

Incidentally, the energization time of the solenoid 205 is larger at the point 602 as compared with the point 601, and thus, the valve closing lag time increases between the turn-off of the injection pulse and the closing of the valve body 214 as indicated by an alternate long and short dash line 703, and as a result, the injection quantity also increases. Next, the valve body 214 starts to the valve closing at the timing when the bound of movable element becomes the largest after the movable element 202 collides with the fixed core 207 at a point 603 where the injection quantity is smaller than that in the case of the alternate long and short dash line 630, and thus, the displacement quantity of the valve body 214 has a trajectory indicated by an alternate long and two short dashes line 703, and the valve closing lag time is shorter than that under a condition of an alternate long and short dash line 702. As a result, the injection quantity at the point 603 is smaller than that at the point 602.

In addition, time profiles of the valve body 214 at points 632, 601 and 631 of the individuals $Q_u$, $Q_c$ and $Q_l$ in the injection pulse width Ti at $t_{61}$ in FIG. 6 are indicated by 706, 705 and 704 respectively. When the injection pulse width 701 at a timing t61 is input to the drive circuit, a valve opening start timing when the valve body 214 starts the valve opening after turning on the injection pulse change like $t_{71}$, $t_{72}$ and $t_{73}$ due to the influence of individual differences among the fuel injection devices. When the same injection pulse width is applied to the fuel injection devices of the respective cylinders, the individual 704 with an earlier valve opening start timing has the largest displacement quantity of the valve body 214 at a timing $t_{74}$ when the injection pulse width is turned off.

Even after the injection pulse width is turned off, the valve body 214 continues to be displaced by kinetic energy of the movable element 202 and a magnetic suction force generated depending on a residual magnetic flux due to the influence of an eddy current, and the valve body 214 starts the valve closing at a timing $t_{77}$ when the force in the valve opening direction by the kinetic energy of the movable element 202 and the magnetic suction force falls below the force in the valve closing direction. Accordingly, the individual having a later valve opening start timing has a larger lift quantity of the valve body 124, and the valve closing lag time increases.

Therefore, the injection quantity is strongly affected by the valve opening start timing of the valve body 214 and the valve closing finish timing of the valve body 214 in the intermediate opening where the valve body 214 does not reach the maximum opening. If individual variations of the valve opening start timing and the valve closing finish timing of the fuel injection devices of the respective cylinders can be detected or estimated by the drive device, the displacement at the intermediate opening can be controlled, and the injection quantity can be stably controlled even in the region with the intermediate opening by reducing the individual variations of the injection quantity.

Figure 8:
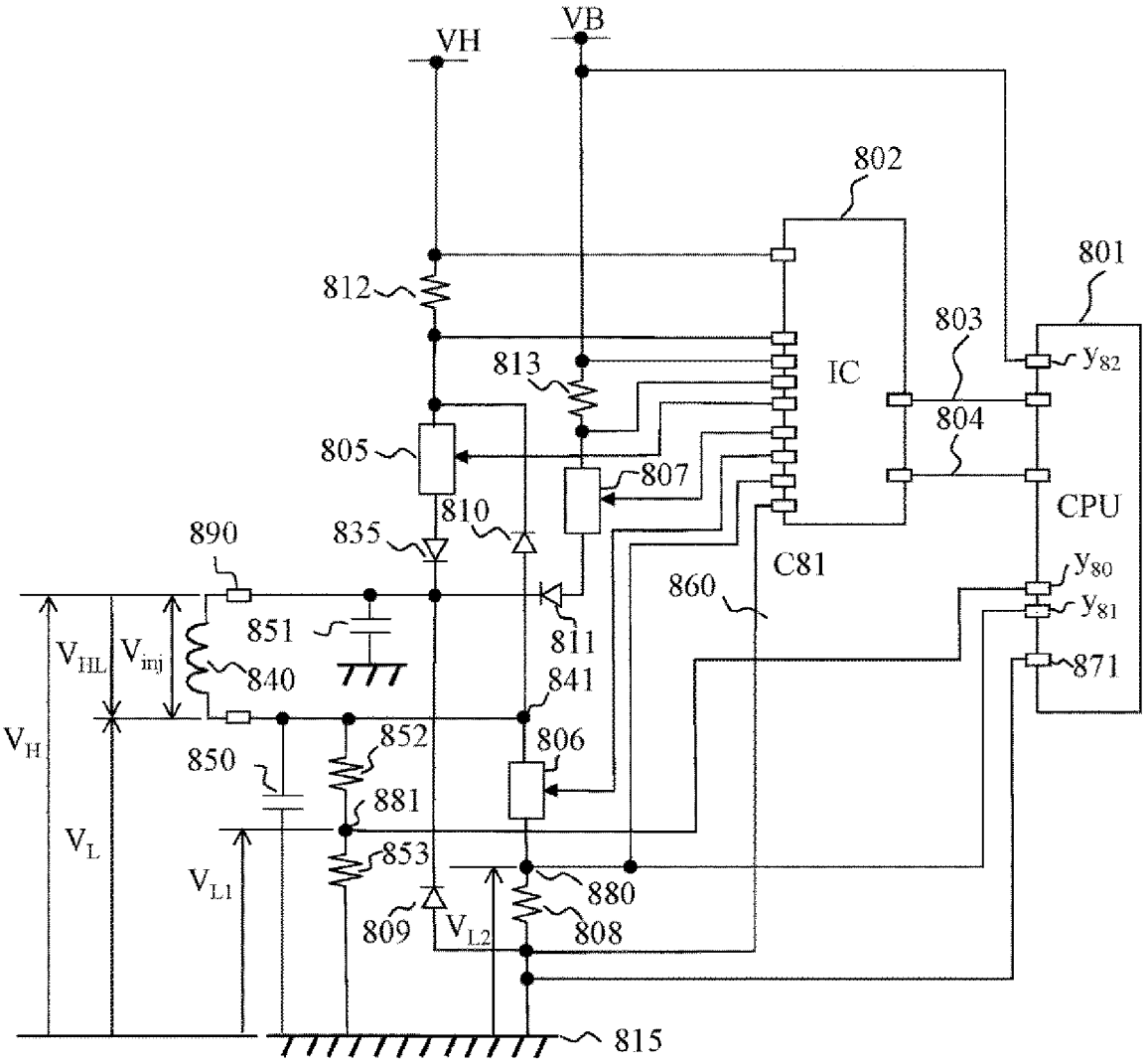
FIG. 8 is a diagram illustrating details of the drive device for fuel injection devices and the ECU (engine control unit) according to the first to four embodiments of the present invention.

Next, the configuration of the drive device for fuel injection devices according to the first embodiment of the present invention will be described with reference to FIG. 8. FIG. 8 is a diagram illustrating details of the drive circuit 103 and the ECU 104 of the fuel injection device.

A CPU 801 is built in, for example, the ECU 104, and receives signals, which indicate each state of the engine, of the pressure sensor mounted on a fuel supply pipe upstream of the fuel injection device, an A/F sensor to measure an inflow air quantity into an engine cylinder, an oxygen sensor to detect the oxygen concentration in an exhaust gas emitted from the engine cylinder, a crank angle sensor and the like from the above-described various sensors, and performs computation of the injection pulse width for control of the injection quantity to be injected from the fuel injection device and the injection timing in accordance with the operating condition of the internal combustion engine.

In addition, the CPU 801 also performs computation of the pulse width (that is, the injection quantity) of an appropriate injection pulse width Ti and the injection timing in accordance with the operating condition of the internal combustion engine and outputs the injection pulse width Ti to a drive IC 802 of the fuel injection device via a communication line 804. Thereafter, the energization and non-energization of switching elements 805, 806 and 807 are switched by the drive IC 802 to supply the drive current to a fuel injection device 840.

The switching element 805 is connected between a high voltage source higher than a voltage source VB, input to the drive circuit, and a terminal of the fuel injection device 840 on the high voltage side. The switching elements 805, 806 and 807 are configured using, for example, a FET or a transistor, and can switch the energization/non-energization of the fuel injection device 840. A step-up voltage VH, which is a voltage value of the high voltage source, is 60 V, for example, and is generated by stepping up the battery voltage using a step-up circuit. A step-up circuit 814 is configured using, for example, a DC/DC converter or the like. In addition, a diode 835 is provided between a power supply-side terminal 890 of the solenoid 205 and the switching element 805 so that the current flows from a second voltage source in a direction toward the solenoid 205 and an installation potential 815, further, a diode 811 is provided also between the power supply-side terminal 890 of the solenoid 205 and the switching element 807 so that the current flows from the battery voltage source in the direction toward the solenoid 105 and the installation potential 815, and the current does not flow from a ground potential 815 toward the solenoid 205, the battery voltage source, and the second voltage source during energization of the switch element 808. In addition, a register and a memory are mounted to the ECU 104 in order to store numerical data required for control of the engine such as the computation of the injection pulse width. The register and the memory are included in the drive device 150 or the CPU 801 inside the drive device 150.

In addition, the switching element 807 is connected between the low voltage source VB and the high-voltage terminal of the fuel injection device. The low voltage source VB is, for example, the battery voltage, and the voltage value thereof is about 12 to 14 V. The switching element 806 is connected between a terminal of the fuel injection device 840 on the low voltage side and the ground potential 815. The drive IC 802 detects a value of the current flowing in the fuel injection device 840 using resistors 808, 812 and 813 for current detection, switches energization and non-energization of the switching elements 805, 806 and 807 according to the detected current value, and generates a desired drive current. Diodes 809 and 810 are provided to apply a reverse voltage to the solenoid 205 of the fuel injection device and to rapidly reduce the current being supplied to the solenoid 205. The CPU 801 performs communication with the drive IC 802 via the communication line 803 and can switch the pressure of fuel supplied to the fuel injection device 840 and the drive current generated by the drive IC 802 depending on operating conditions. In addition, both ends of each of the resistors 808, 812 and 813 are connected to A/D conversion ports of the IC 802 so that the voltage applied to both the ends of each of the resistors 808, 812 and 813 can be detected by the IC 802. In addition, capacitors 850 and 851, configured to protect signals of an input voltage and an output voltage from a surge voltage or noise, may be provided on the Hi side (voltage side) and the ground potential (GND) side, respectively, of the fuel injection device 840, and a resistor 852 and a resistor 853 may be provided downstream of the fuel injection device 840 in parallel with the capacitor 850.

In addition, a terminal y80 may be provided so that a potential difference VL1 between a terminal 881 and the ground potential 815 can be detected by the CPU 801 or the IC 802. It is possible to divide a potential difference VL between the ground potential (GND)-side terminal of the fuel injection device 840 and the ground potential by setting a resistance value of the resistor 852 to be a larger resistance value than the resistor 853. As a result, it is possible to decrease the voltage value of the detected voltage VL1, to reduce a withstand voltage of the A/D conversion port of the CPU 801, and to minimize the cost of the ECU. In addition, a potential difference VL2 between a terminal 880 the resistor 808 on the fuel injection device 840 side and the ground potential 815 by the CPU 801 or the IC 802. It is possible to detect the current flowing in the solenoid 205 by detecting the potential difference VL2.

Figure 9:
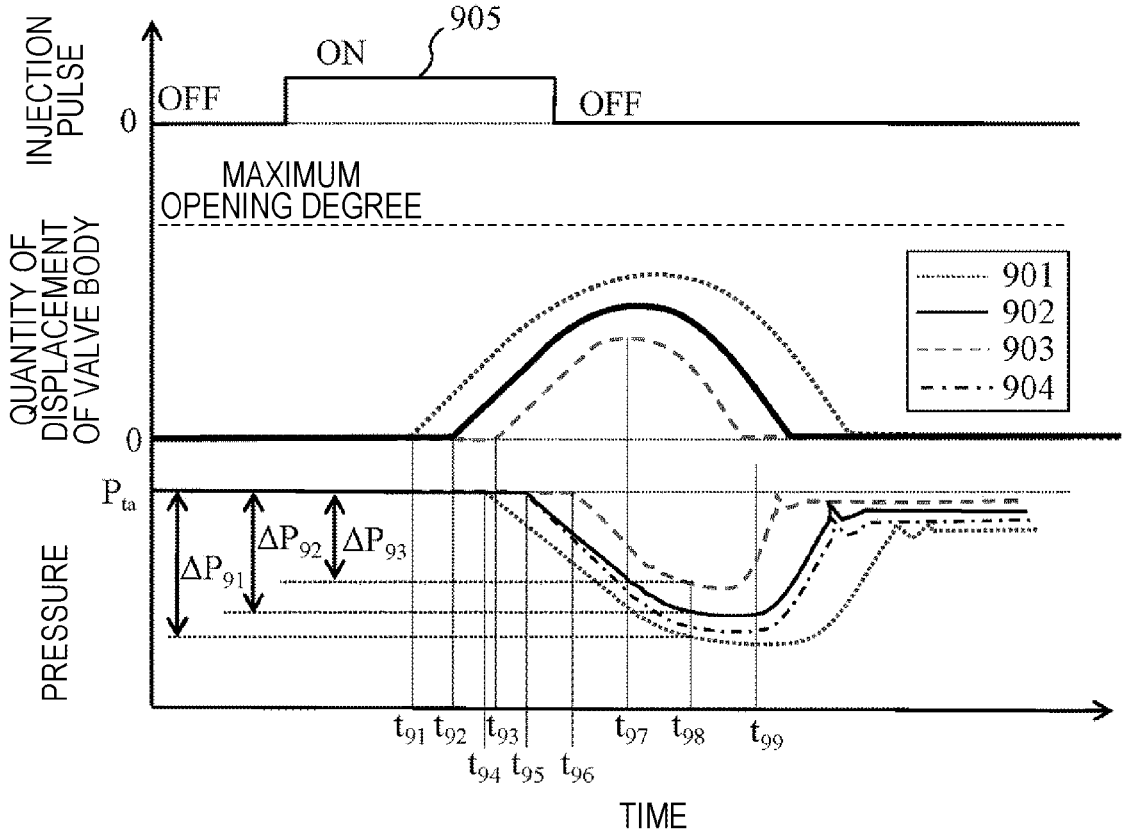
FIG. 9 is a diagram illustrating relationships among quantities of displacement of individual valve bodies of three fuel injection devices having different trajectories of valve bodies, the pressure detected by the pressure sensor, and time under conditions of an intermediate opening and application of the same injection pulse width according to the first embodiment.

Next, a description will be given regarding a method of estimating the fuel injection quantity variation and a method of correcting the fuel injection quantity variation according to the first embodiment with reference to FIGS. 9 and 10. FIG. 9 is a diagram illustrating relationships among quantities of displacement of the valve bodies 214 of individuals 901, 902, 903 of three fuel injection devices having different trajectories of the valve bodies 214, the pressure detected by the pressure sensor, and time under conditions that the valve body 214 is driven at the intermediate opening and the same injection pulse width is applied. In addition, FIG. 9 describes pressure of an individual 904 having the same trajectory of the valve body 214 as the individual 903 and a larger injection quantity than the individual 903. In addition, pressure before injection, which is detected by the pressure sensor, will be referred to as $P_{ta}$, each difference between the pressure $P_{ta}$ and each pressure of individuals 901, 902 and 903 detected at a timing $t_{98}$ will be referred to as pressure drops $\Delta P_{91}$, $\Delta P_{92}$ and $\Delta P_{93}$.

Incidentally, the injection pulse illustrated in FIG. 9 is a valve opening signal. The injection pulse, which is the valve opening signal, is generated by the ECU 104. It is possible to control the valve opening start timing of the valve body 214 by adjusting the time or timing when the injection pulse is turned on. In addition, the pressure sensor 102, configured to detect the pressure of fuel supplied to the fuel injection device, is attached to the rail pipe 105 or the fuel injection device 840. A pressure signal acquiring unit in FIG. 9 is a part of the function of the ECU 104. In addition, the pressure signal acquiring unit has a function of acquiring pressure information output from the pressure sensor 102 at a predetermined timing based on the valve opening signal by the CPU 801 or IC 802.

The relationship between the displacement quantity of the valve body 214 and the pressure will be described using the individual 902. In a state where the injection pulse is turned off and the valve body 214 performs the valve closing, the pressure value detected by the pressure sensor is held to a target fuel pressure $P_{ta}$ set by the ECU. When the injection pulse is turned on, the magnetic suction force acts on the movable element 202, the valve body 214 starts the valve opening at a timing $t_{92}$ when the force in the valve opening direction such as the magnetic suction force exceeds the force acting in the valve closing direction. After the valve body 214 starts the valve opening, the pressure drop occurs inside the fuel injection device and inside the rail pipe 105 according to the fuel injection, and the pressure decreases beyond a timing $t_{93}$. Thereafter, the pressure starts to increase beyond a timing $t_{97}$ when the displacement quantity of the valve body 214 is the largest. The time-series profile of the pressure detected by the pressure sensor corresponds to a flow rate per unit time which is injected from the fuel injection device, and a time integral value of the flow rate per unit time corresponds to the injection quantity of the individual.

The fuel pressure at the timing t98 after elapse of a certain time from the turning-on of the injection pulse as the valve opening signal has the smaller pressure drop $\Delta P_{93}$ in the individual 903 having the small displacement quantity of the valve body 214 and has the larger pressure drop $\Delta P_{91}$ in the individual 901 having the large displacement quantity of the valve body 214 This is because the injection quantity depends on the displacement quantity of the valve body 214, and the pressure drop increases as the injection quantity increases. In addition, when the individual 903 and the individual 904 are compared, the timing $t_{93}$ when the pressure decreases matches therebetween since the displacement of the valve body 214 in the solid line is equal, but the individual 904 has the larger pressure drop at the timing $t_{98}$.

The pressure detected at the timing $t_{98}$ detects two factors of flow rate variations due to e individual differences of the displacement of the valve body 214 and flow rate variations due to individual differences in nozzle dimensional tolerance such as an injection hole diameter.

That is, it is possible to detect each pressure drop of the individuals corresponding to the injection quantity by detecting the pressure at a predetermined timing on the basis of information of the valve opening signal in the pressure signal acquiring unit. To be specific, each pressure of the individual 901, the individual 902, the individual 903, and the individual 904 may be detected at the predetermined timing $t_{98}$ using the injection pulse, which is the valve opening signal, to count the timing when the injection pulse is turned on as a start point. If the relationship between the pressure detected by the pressure sensor 102 and the injection quantity is stored as MAP data or a computation expression in the register of the drive device 150 in advance, it is possible to estimate an injection quantity from the pressure detected for each individual.

In addition, the timing $t_{98}$ to detect the pressure may be set to be the timing after the elapse of a certain time from the turning-on of the injection pulse or set using sensor information detected by the drive device 150. The sensor information is, for example, an angle (crank angle) of a crankshaft which is detected by a crank angle sensor. There is a case in which the control of a fuel injection timing or the like is performed by calculating a speed of a piston from a detection value of the crank angle and computing the injection timing and an energizing pulse using the ECU through conversion into time. When the timing to detect the pressure is determined based on the detection value of the crank angle, it is possible to reduce a calculation error at the time of converting the detection value of the crank angle into the time and to accurately control the timing to detect the pressure.

Next, a description will be given regarding an injection quantity correction method which is performed in a fuel injection quantity variation correcting unit with reference to FIGS. 5 and 10. FIG. 10 is a diagram illustrating a flowchart of the injection quantity correction method. The fuel injection quantity variation correcting unit is a part of software which is executed on the CPU 801. In addition, the fuel injection quantity variation correcting unit has a function of adjusting an energization time or an energization current of the solenoid 205 for each individual of the fuel injection devices so that a divergence value between a target injection quantity determined by the drive device 150 and an estimation value of the injection quantity of the fuel injection device of each cylinder becomes small.

The energization time of the solenoid 205, which serves as a means for adjusting the injection quantity for each individual, is the time passing from the current flows to the solenoid 205 until reaching the peak current $I_{peak}$. Alternatively, the energization time may be set to the time of the injection pulse width Ti or the time between the turning-on of the injection pulse and the arrival at the peak current $I_{peak}$ (hereinafter, referred to as a high voltage application time Tp). In addition, the energization current is the peak current $I_{peak}$. Incidentally, the injection pulse width is used as the energization time of the solenoid 205 which serves as the means for adjusting the injection quantity for each individual in FIG. 10.

Figure 10:
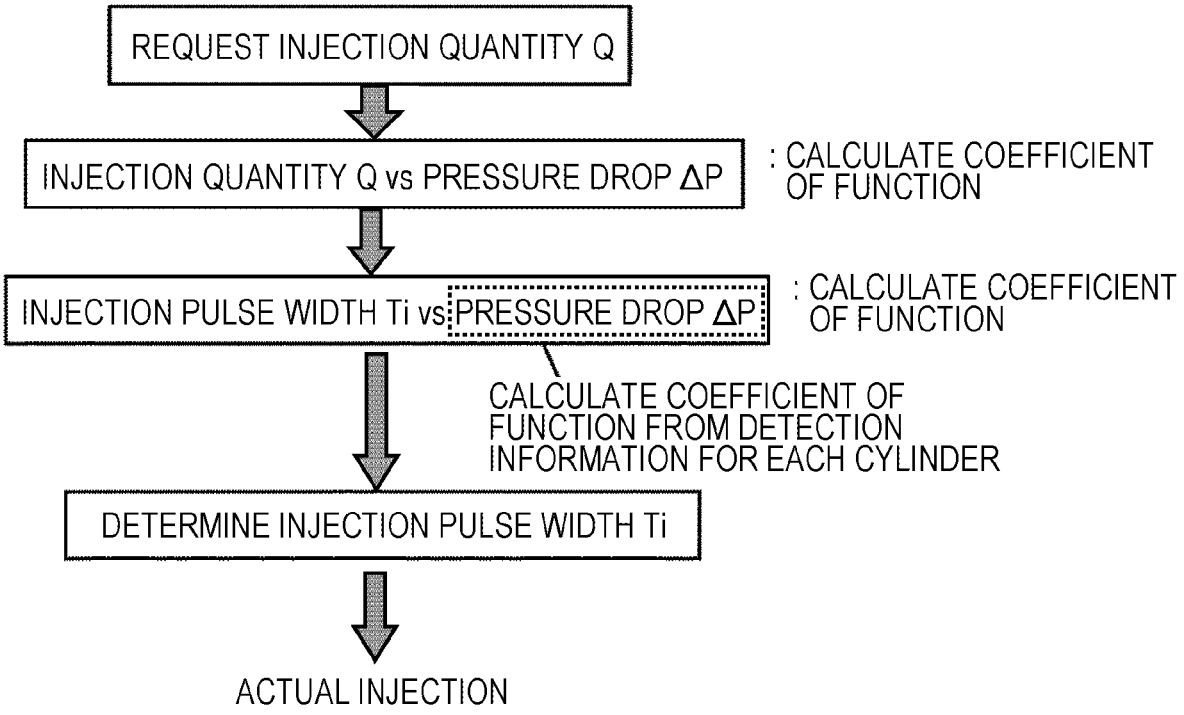
FIG. 10 is a diagram illustrating a flowchart of a method of correcting the injection quantity which is provided in a fuel injection quantity variation correcting unit according to the first and second embodiments of the present invention.

In FIG. 10, it is necessary to be capable of computing each relationship between the injection quantity and the pressure drop ΔP and between the injection pulse width and the pressure drop ΔP using the ECU 104 for each individual in order to determine an injection pulse width for injection of a required injection quantity in each individual from the required injection quantity determined by the ECU 104. The relationship between the pressure drop ΔP and the injection quantity detected by the ECU 104 using the pressure sensor may be expressed as a function and set in the CPU 801 of the drive device 150 in advance. As described above, the pressure detection value has a correspondence with the injection quantity of the fuel injection device, and the relationship between the injection quantity and the pressure drop ΔP can be expressed by, for example, a relationship of the first-order approximation.

The pressure drop ΔP is acquired with each injection pulse width Ti, and a coefficient of the function of the pressure drop ΔP of each cylinder from the detection value of the pressure drop and the injection quantity is determined based on the relationship between the injection pulse width Ti and the pressure drop ΔP. The relationship between the detected pressure drop ΔP and the injection pulse width Ti can be expressed by, for example, the relationship of the first-order approximation, and it is possible to calculate a gradient and an intercept as coefficients of the function of each individual. The relationship between the injection pulse width Ti and the injection quantity at the intermediate opening is expressed by the function of the first-order approximation, it is possible to calculate a coefficient of an approximation expression by detecting the pressure drop ΔP under conditions of at least two or more points having different injection pulse widths Ti using the ECU.

As described above, the valve opening signal to drive the fuel injection device, the pressure signal acquiring unit, and the fuel injection quantity variation correcting unit are provided, and accordingly, the injection pulse width Ti is suitably corrected for each cylinder with respect to the target value of the injection quantity computed by the ECU 104 That is, the drive device for fuel injection devices of the present embodiment performs control so that predetermined quantities of fuel is injected by causing the current to flow in the solenoid 205 to drive the movable valve (the movable element 202 and, the valve body 214) and causing the current to flow to the solenoid 205 of each of the plurality of fuel injection devices (101A to 101D), which open or close fuel flow paths, for the set energization time until reaching the energization current (the peak current Ipeak). Further, the set energization time or the energization current (the peak current Ipeak) described above is corrected based on the pressure detection value from the pressure sensor 102 that is attached to the fuel supply pipe (the rail pipe 105) upstream of the plurality of fuel injection devices (101A to 101D).

To be more specific, it is estimated that a fuel injection device has a larger spray amount as the amount of the voltage drop of the pressure sensor 102 when each of the fuel injection devices (101A to 101D) injects the fuel increases, and thus, the set energization time or the energization current (the peak current Ipeak) is corrected to be short for the fuel injection device.

Accordingly, it is possible to correct the injection quantity at the intermediate opening and to perform the precise and minute injection quantity control. In addition, it is possible to minimize the pressure detection frequency required for the injection quantity correction, the responsiveness of pressure sensor, the time resolution required for receiving the pressure by the ECU 104 as compared to the case of detecting the time-series profile of pressure using the ECU 104, and thus, it is possible to minimize the computational load of the ECU 104 and the cost of the pressure sensor.

That is, it is possible to suitably determine the injection pulse width Ti of each individual, for injection of the required injection quantity using each individual, with respect to the required injection quantity computed by the drive device 150 by setting of the injection quantity, the pressure drop ΔP, and a relational expression between the injection pulse width and the pressure drop ΔP obtained as the function in the register of the drive device 150 in advance for each individual of the fuel injection devices, and calculating the coefficient of the function from the detection value of the pressure drop. In addition, it is possible to minimize the number of data points required for storage in the resister using a method of obtaining the coefficient of the function for each individual as compared to the case of setting the MAP data in the register of the drive device 150, and there is an effect of enabling minimization of memory capacity of the register of the drive device 150.

In addition, the estimation of the injection quantity at the intermediate opening may be performed under a condition with an intermediate opening where the injection quantity is small. When the valve body 214 transitions to the valve closing operation after reaching the maximum opening, fuel injection quantity variations due to individual differences of the maximum opening are generated in the pressure detection value in addition to the fuel injection quantity variations during the valve opening operation of the valve body 214 and the fuel injection quantity variations due to a nozzle size. In this case, a cross-sectional area of a seat portion fuel passage between the valve body 214 and the valve seat 118 is changed due to the individual differences of the maximum opening, and the injection quantity is also changed. A maximum value of the displacement quantity of the valve body 214 at the intermediate opening does not depend on the maximum opening, and thus, the influence of the individual differences of the maximum opening on the fuel injection quantity variations at the intermediate opening is small.

In addition, when the valve body 214 transitions to the valve closing operation after reaching the maximum opening, the injection quantity increases as compared to the condition of the intermediate opening. Under the condition with the large injection quantity, there is a case in which each pressure inside the rail pipe 105 and the fuel injection devices 101A to 101D changes due to the pressure drop caused by the fuel injection of the fuel injection device into each cylinder and discharge of the high-pressure fuel from the fuel pump, thereby causing a pressure pulsation. An amplitude of the pressure pulsation becomes larger as the injection quantity becomes larger, and thus, there is a case in which the pressure pulsation is superimposed on the pressure detected by the pressure sensor, and an error is caused in the fuel injection quantity variation estimation. When the injection quantity is estimated under the condition of the intermediate opening, the condition to detect the pressure may be performed at the intermediate opening. As above, it is possible to decrease the influence of the pressure pulsation on the pressure detection value and to enhance estimation accuracy of the injection quantity.

Incidentally, the fuel discharge from the fuel pump 106 inside the rail pipe 105 may be stopped under the condition where the pressure detection for estimation of the fuel injection quantity variation is performed. In other words, the pressure inside the rail pipe 105 increases when the high pressure fuel is discharged from the fuel pump 106 inside the rail pipe 105 between the injection of fuel for the pressure detection to estimate the fuel injection quantity variation and the timing of detecting the pressure in the state in which there is no fuel discharge from the fuel pump 106 inside the rail pipe 105. Due to this influence, the pressure detected by the pressure sensor is increased. It is possible to accurately detect the pressure drop due to the fuel injection by stopping the discharge of the high pressure fuel from the fuel pump under the condition that the fuel injection quantity variation of each individual is estimated, and thus, it is possible to enhance the accuracy in the estimation of the injection quantity.

In addition, a mounting position of the pressure sensor 102 will be described with reference to FIG. 1. In the case of estimating the injection quantity using a single sensor of the pressure sensor 102 for the fuel injection devices of the respective cylinders, each distance from injection holes of the fuel injection devices of the respective cylinder to the fuel pressure sensor differs among the respective cylinders. Therefore, even when the injection quantity injected by each fuel injection device is the same and the pressure drop is the same, there is a case in which values detected by the pressure sensor are affected by individual differences of the distance between each injection hole 119 and the pressure sensor 102. In this case, the influence of the individual differences of the distance between the injection hole 119 and the pressure sensor 102 may be set in the register of the ECU in advance as a correction value to be multiplied by the pressure drop. According to the above configuration, it is possible to secure the accuracy of the injection quantity estimation even when the pressure sensor 102 is attached to an end face of the rail pipe 105.

In addition, the pressure sensor 102 may be attached to the vicinity of a bonding portion 121 between the pipe 120 of the fuel pressure pump 106 and a rail pipe 105. In this case, each distance between the bonding portion 121 and the injection hole 119 of each of the fuel injection devices 101B and 101C is substantially constant, and further, each distance between the bonding portion 121 and the injection hole 119 of each of the fuel injection devices 101A and 101D is substantially constant. In addition, there is an effect of enabling a decrease in maximum distance between the pressure sensor 102 and the injection hole 119 as compared to the case of providing the pressure sensor 102 at the end face of the rail pipe 105, and thus, the change in pressure due to the pressure drop is easily detected, and it is possible to enhance the accuracy of the injection quantity estimation.

In addition, the two pressure sensors 102 may be provided at both ends 140 and 141 of the rail pipe 105. The pressure sensor pressure sensor provided at both the ends 140 will be referred to as a first pressure sensor, and the pressure sensor provided at both the ends 141 will be referred to as a second pressure sensor. In this case, when the bonding portion 121 between the pipe 120 of the fuel pressure pump 106 and the rail pipe 105 is attached to one of both the ends 140 and 141 of the rail pipe 105, a pressure detected by the first pressure sensor and a pressure detected by the second pressure sensor, which are detected under a condition that the fuel pressure supplied to the fuel injection device is the same, may be compared and referred to. Through the comparative reference, it is possible to accurately compute the correction value, which is applied in the register of the ECU for correction of the influence of the differences in distance between the pressure sensor and the injection hole 119 of each of the fuel injection devices 101A to 101D of the cylinders affecting on the pressure detection value, and the pressure correction accuracy is enhanced, and thus, the accuracy of the injection quantity estimation is improved.

In addition, the pressure sensor 102 may be provided at mounting portions 130, 131, 132 and 133 of the rail pipe 105 positioned above the fuel injection devices 101A to 101D or each individual of the fuel injection devices. The pressure drop due to the fuel injection is easily detected near the injection hole 119 to inject the fuel. Therefore, when the pressure sensor 102 is provided in each individual of the fuel injection devices, it is possible to improve the pressure correction accuracy the most, but there is a case in which it is difficult to secure a mounting space required for provision of the pressure sensor 102 upon the structure of the fuel injection device. In addition, it is possible to keep each distance between the injection hole 119 and each pressure sensor to be constant by providing the pressure sensor 102 at the mounting portions 130, 131, 132 and 133 of the rail pipe 105 for each cylinder, and to reduce the influence of the pressure pulsation or the like which causes the error in the pressure detection value for each fuel injection device of the cylinders. As a result, it is possible to improve the accuracy of the injection quantity estimation and to accurately control the injection quantity.

Second Embodiment

Next, a description will be given regarding a method of estimating the fuel injection quantity variation according to a second embodiment with reference to FIGS. 9 and 11 to 14. Incidentally, a fuel injection device, a pressure signal acquiring unit, and a fuel injection quantity variation correcting unit according to the present embodiment have the same configurations as those of the first embodiment.

Figure 11:
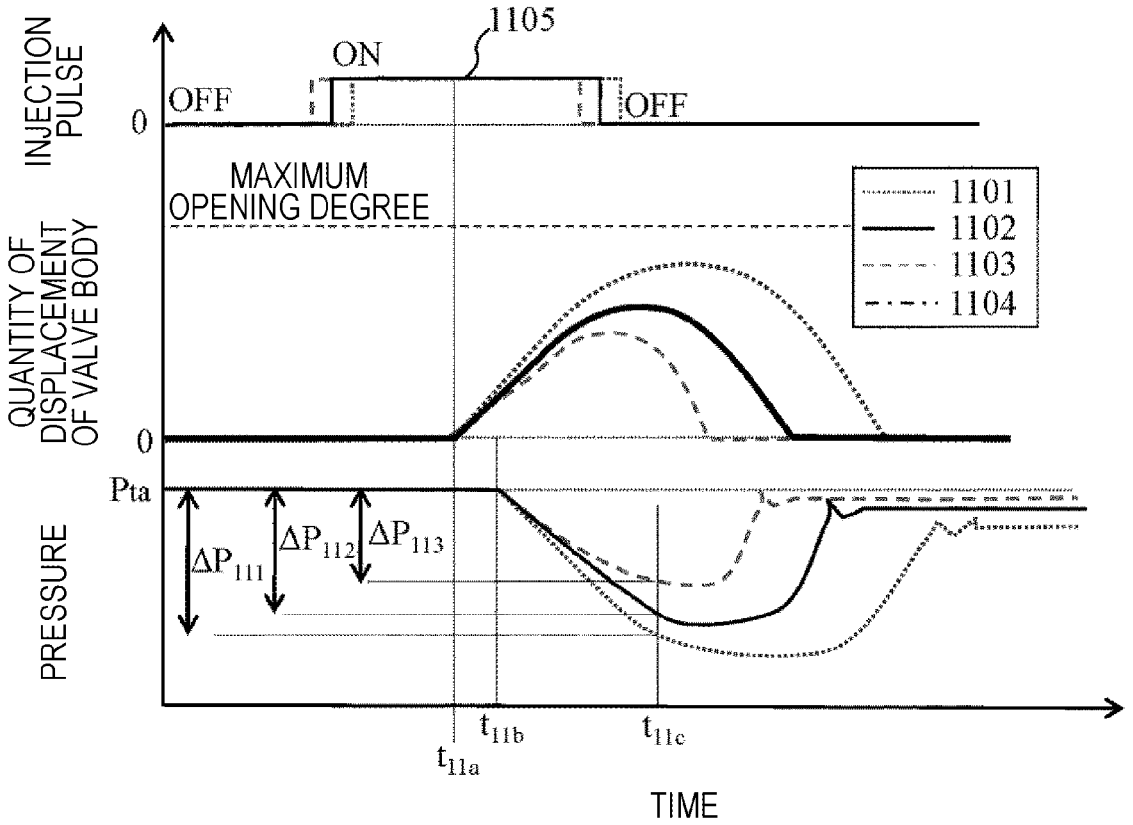
FIG. 11 is a diagram illustrating relationships among the injection pulse, the valve body displacement quantity, pressure, and time when a valve opening start timing of the valve body is aligned for each individual fuel injection device according to the second embodiment of the present invention.

FIG. 11 is a diagram illustrating an injection pulse, a valve body displacement quantity, and pressure in a time-series manner when each valve opening start timing of the valve body 214 is aligned among individuals 1101, 1102 and 1103 according to the second embodiment of the present invention. A difference of the second embodiment from the first embodiment is that information from the pressure sensor 102 is detected at a pressure information signal meaning based on an operation timing of the valve body 214.

A valve opening finish detecting unit and a valve closing finishing unit are a part of functions of hardware of the drive circuit 103 and the ECU 104 and a part of software which is executed on the CPU 801. In addition, the valve opening finish detecting unit has functions of detecting a temporal change in current of the solenoid 205 using the ECU 104 and detecting a valve opening finish timing when the valve body 214 reaches the maximum opening. In addition, the valve closing finish detecting unit has functions of acquiring a voltage of the solenoid 205, detecting a temporal change thereof using the ECU 104 and detecting a valve closing timing when the valve body 214 reaches the valve seat 218.

The valve opening start estimating unit is a part of the software which is executed on the CPU 801. In addition, the valve opening start estimating unit has a function of estimating a valve opening start timing of the valve body 214 of each individual by multiplying a detection value obtained by the valve opening finish detecting unit or the valve closing finish detecting unit by a correction constant set in the register of the drive device 150 in advance. The pressure signal acquiring unit according to the second embodiment has a function of acquiring information from the pressure sensor 102 at a predetermined timing using the ECU 104 based on the valve opening start timing estimated by the valve opening start estimating unit.

To be more specific, a pressure drop is obtained by subtracting a pressure value detected by the pressure sensor 102 at the valve opening start timing estimated by the valve opening start estimating unit from a pressure value detected by the pressure sensor 102 at the valve closing finish timing estimated by the valve closing finish detecting unit.

First, a description will be given regarding a method of estimating an injection quantity by estimating the valve opening start timing of the valve body 214 for each individual and acquiring a fuel pressure based on the detection information thereof with reference to FIGS. 9 and 11. The pressure drop due to the fuel injection of each individual has a correspondence with the injection quantity of each individual, and the injection quantity is determined by the time-series profile of displacement quantity of the valve body 214. In addition, the pressure drop is caused by the fuel injection after the valve body 214 starts the valve opening, and thus, the pressure drop is linked with the valve opening start timing of the valve body 214.

From FIG. 9, when a pressure at a timing $t_{99}$ is detected by setting the injection pulse width as a detection means for detecting the valve opening, the individuals 902 and 903 have passed each timing at which each pressure becomes the minimum, and each pressure thereof starts to increase. On the other hand, the individual 901 has not passed a timing at which the pressure becomes the minimum, and the pressure is in the middle of decreasing. Therefore, a pressure drop of the individual 902, the individual 903 is detected to be relatively smaller than that of the individual 901 with the pressure detected at the timing $t_{99}$, and thus, there is a case in which a detection value of the pressure drop that needs to be detected and a detection value of the actual pressure drop diverge from each other. As a result, there is a case in which each injection quantity of the individual 902 and the individual 903 is estimated to be smaller than the actual injection quantity as compared to the individual 901.

When the valve opening finish detecting unit or the valve closing finish detecting unit, the valve opening start estimating unit, and the pressure signal acquiring unit are provided as described above, it is possible to detect the valve opening start timing of the valve body 214 for each fuel injection device of each cylinder and to suitably determine the timing to detect the pressure based on the valve opening start timing. As a result, when there are an individual having passed the timing when the pressure thereof become the minimum and an individual not having passed the timing, it is possible to decrease an error in estimation of the injection quantity caused by detection of each pressure. As a result, it is possible to accurately estimate the injection quantity.

Figure 12:
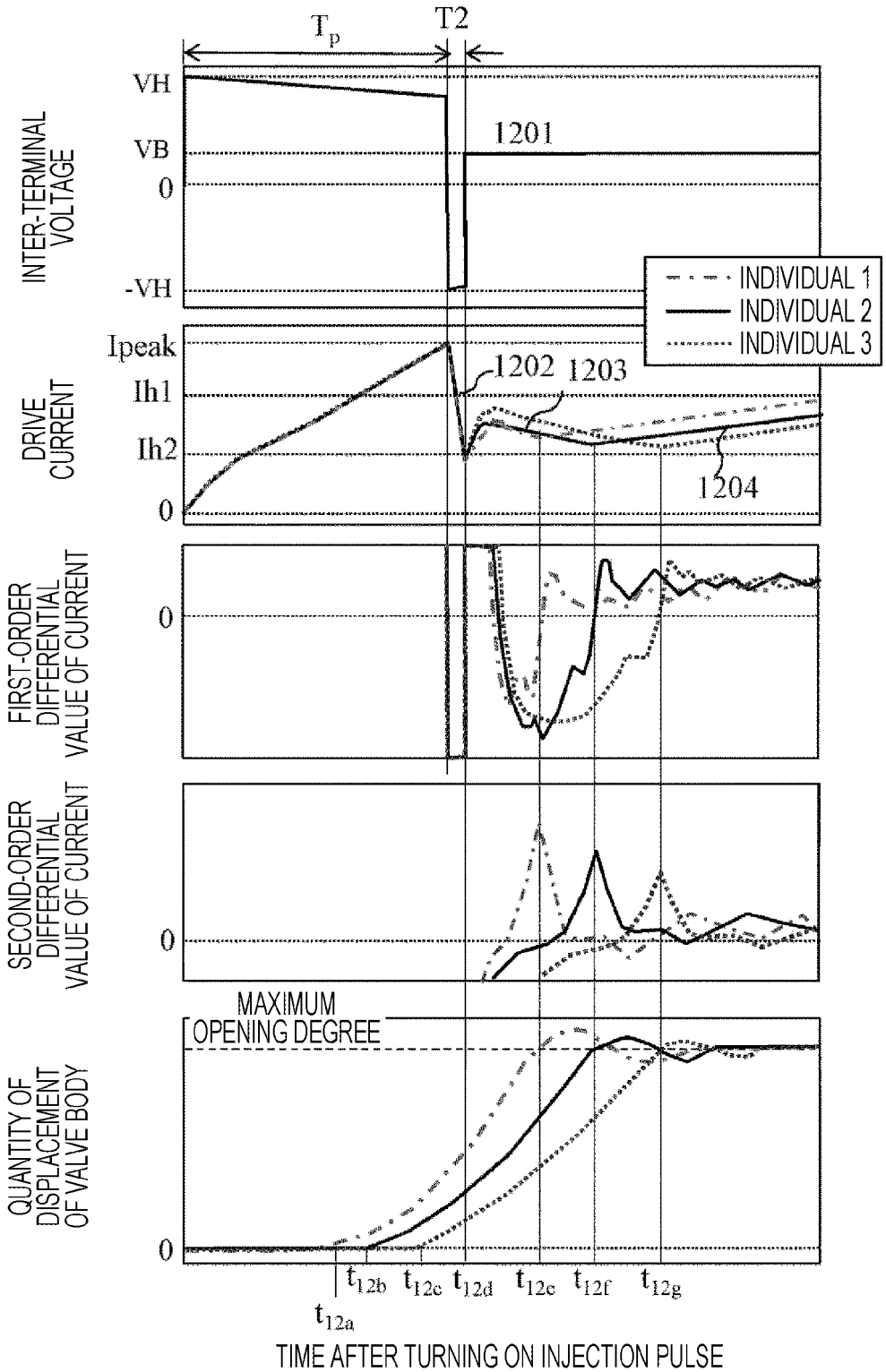
FIG. 12 is a diagram illustrating relationships among inter-terminal voltages of solenoids of three fuel injection devices whose valve body behaviors are changed as being affected by changes in dimensional tolerance, drive currents, current first-order differential values, current second-order differential values, each displacement quantity of each valve body 214, and time according to the second and third embodiments of the present invention.
Figure 13:
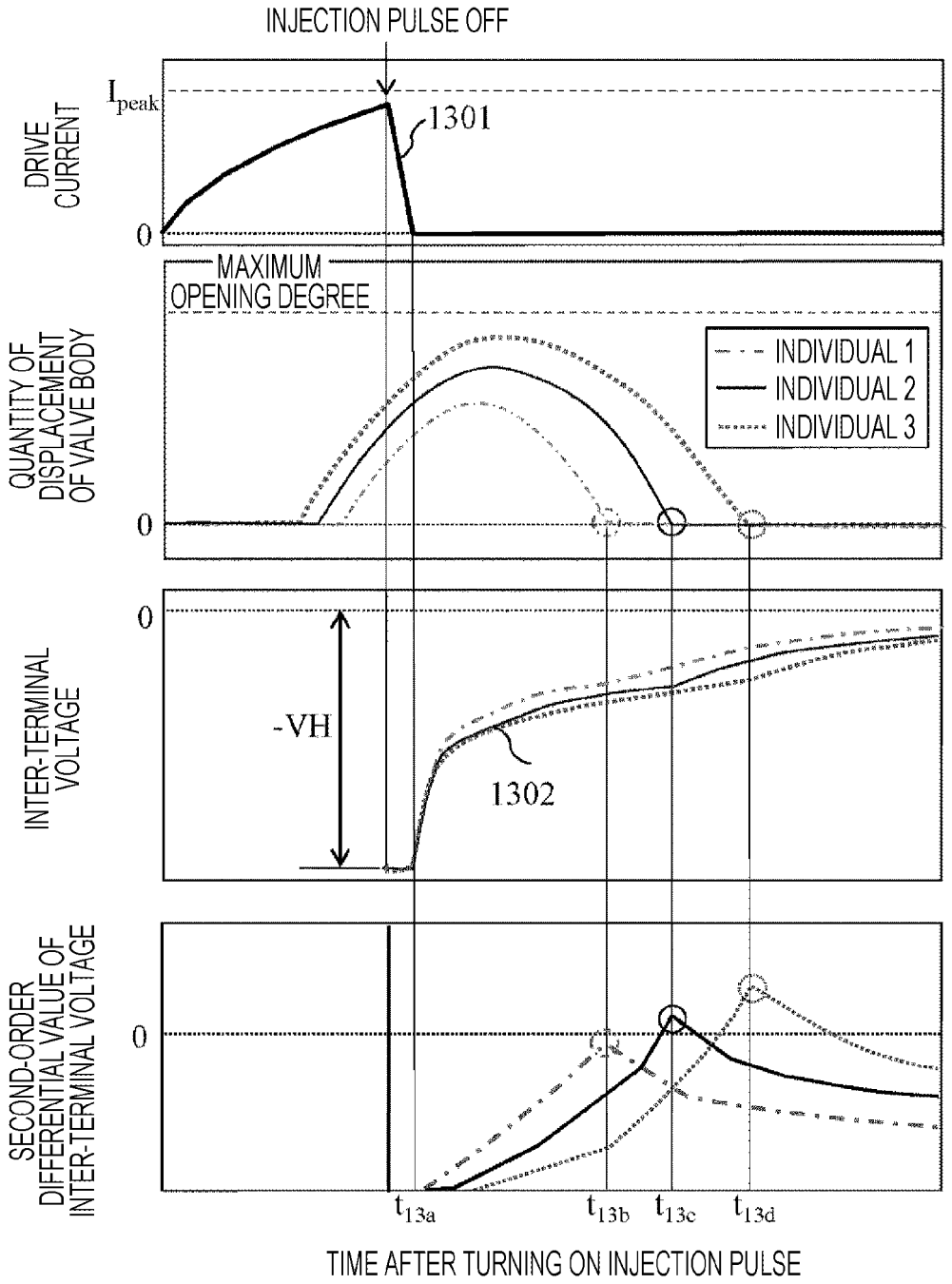
FIG. 13 is a diagram illustrating relationships among the drive currents of the solenoids of three fuel injection devices whose valve body behaviors are changed as being affected by changes in dimensional tolerance, the valve body displacement quantities, the inter-terminal voltages, and second-order differential values of the inter-terminal voltages, and time according to the second and third embodiments of the present invention.
Figures 14, 15:
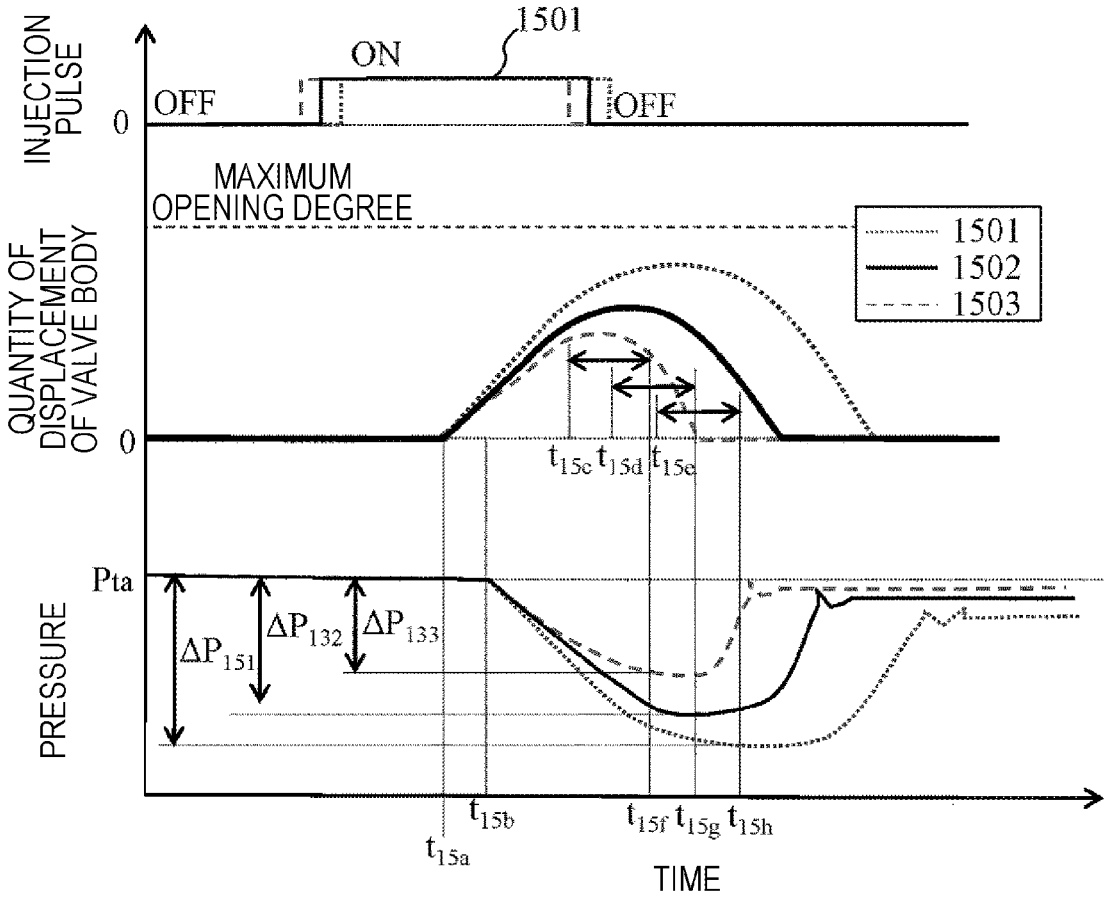
FIG. 14 is a table illustrating correspondences among a displacement between a movable element and a fixed core after stopping the injection pulse, a magnetic flux passing through the movable element, and a voltage, which serves as a principle of detection of a valve closing finish timing according to the second and third embodiments of the present invention.
FIG. 15 is a diagram illustrating relationships among the injection pulse, the valve body displacement quantity, pressure, and time when each valve opening start timings of each individual is aligned using an injection pulse Ti according to the second embodiment of the present invention.

Next, a description will be given regarding two valve opening start estimating units that estimate the valve opening start timing of the fuel injection device with reference to FIGS. 12 to 14.

A first valve opening start estimating unit is provided with a valve opening finish detecting unit, which detects a change in velocity or acceleration of the movable element 202 when the movable element 202 reaches the maximum opening as a temporal change in current flowing in the solenoid 205 and detects a timing when the movable element reaches the maximum opening from the detection value thereof, and has a function of estimating the valve opening start timing by multiplying the valve opening finish timing detected by the valve opening finish detecting unit by a correction constant.

A second valve opening start estimating unit is provided with a valve closing finish detecting unit, which detects a change in acceleration of the movable element 202 caused at a valve closing finish timing when the valve body 214 collides with the valve seat 218 as a temporal change in voltage of the solenoid 205 and detects the valve closing finish timing of the valve body 214 from the detection value thereof, and has a function of estimating the valve opening start timing by multiplying the valve opening finish timing detected by the valve closing finish detecting unit by a correction constant. The first valve opening start estimating unit will be described with reference to FIG. 12. FIG. 12 is a diagram illustrating relationships among an inter-terminal voltage $V_{inj}$ of the solenoid 205, a drive current, a current first-order differential value, a current second-order differential value, a displacement quantity of the valve body 214, and time after turning on the injection pulse. Incidentally, three profiles of each individual of the fuel injection devices 840 having different operation timings of the valve body 214 due to changes of the force acting on the movable element 202 and the valve body 214 caused by the dimensional tolerance are described in the drive current, the current first-order differential value, the current second-order differential value, and the displacement quantity of the valve body 214 in FIG. 12. From FIG. 12, the current is rapidly increased first by turning on the switching elements 805 and 806 and applying the step-up voltage VH to the solenoid 205 to increase the magnetic suction force acting on the movable element 202. Thereafter, the switching elements 805, 806 and 807 are turned off when the drive current reaches the peak current value $I_{peak}$ a path is formed from the installation potential 815 to the diode 809, the fuel injection device 840, the diode 810, and the voltage source VH due to a back electromotive force caused by inductance of the fuel injection device 840 so that the current is fed back to the voltage source VH side, and the current having been supplied to the fuel injection device 840 rapidly decreases from the peak current value $I_{peak}$ like a current 1202. When a voltage cutoff period $T_2$ ends, the switching elements 806 and 807 are turned on, and the battery voltage VB is applied to the fuel injection device 840. The peak current value $I_{peak}$ or the high voltage application time $T_p$ and the voltage cutoff period $T_2$ may be set such that the valve opening finish timing of the valve body 214 of each of the individuals 1, 2 and 3, which are the fuel injection devices of the respective cylinders, comes before a timing $t_{12d}$ when the voltage cutoff period $T_2$ ends. A change in application voltage to the solenoid 205 is small under a condition that the application of the battery voltage VB is continued and a voltage value 1201 is applied, and thus, changes of the magnetic resistance accompanying reduction of the magnetic gap between the movable element 202 and the fixed core 207 after the movable element 202 starts to be displaced from the valve closing position can be detected as changes of the induced electromotive force using the current. When the valve body 214 and the movable element 202 start to be displaced, the magnetic gap x between the movable element 202 and the fixed core 207 decreases, and thus, the induced electromotive force increases, and the current supplied to the solenoid 205 gradually decreases like 1203. The changes of the magnetic gap rapidly decrease from the timing when the movable element 202 reaches the fixed core 207, that is, from the valve opening finish timing when the valve body 214 reaches the maximum opening, and thus, changes of the induced electromotive force also decrease, and the current value gradually increases like 1204. The magnitude of the induced electromotive force is affected by the current value in addition to the magnetic gap, but the changes of the current are small under a condition that a voltage lower than the step-up voltage VH like the battery voltage VB is applied, and thus, changes of the induced electromotive force due to the gap changes can be easily detected using the current.

The current may be differentiated once to detect timings $t_{12e}$, $t_{12f}$ and $t_{12g}$ when the first-order differential value of current becomes zero as a timing to finish the valve opening in order to detect the timing when the valve body 214 reaches the maximum opening, as a point where the drive current starts to increase after decreasing, for the individuals 1, 2 and 3 of each cylinder of the fuel injection device 840 described above.

In addition, there is a case in which the current may not necessarily decrease due to the changes of the magnetic gap in a configuration of the drive unit and the magnetic circuit in which the induced electromotive force generated by the changes of the magnetic gap are small. In this case, it is possible to detect the valve opening finish timing by detecting the maximum value of the second-order differential value of current detected by the drive device, and it is possible to stably detect the valve opening finish timing under a condition that there is little influence of restriction of the magnetic circuit, the inductance, the resistance value, and the current value. In addition, a BH curve of the magnetic material has a nonlinear relationship between the magnetic field and magnetic flux density. In general, the permeability, which is a gradient between the magnetic field and the magnetic flux density, increases under a condition of a low magnetic field, and the permeability decreases under a condition of a high magnetic field. Thus, the magnetic suction force acting on the movable element 202 may be reduced by increasing the current until reaching the peak current $I_{peak}$ under the condition that the valve opening finish timing is detected to generate the magnetic suction force required for the displacement of the valve body 214 in the movable element 202, and then, providing the voltage cutoff period $T_2$ when the drive current is rapidly decreased before the valve body 214 reaches the valve opening finish timing. Under a condition that the drive current supplied to the solenoid 205 of the fuel injection device 840 is higher than the current value holding the valve body 214 in the valve opening state like the peak current $I_{peak}$, the current value supplied to the solenoid 205 increases, and the magnetic flux density becomes a state close to saturation, in some cases. When the step-up voltage VH in the negative direction is applied for the voltage cutoff period $T_2$ after generating the magnetic suction force required for the valve opening in the movable element 202, and the current is rapidly decreased, it is possible to decrease the drive current at the valve opening finish timing and increase the gradient between the magnetic field and the magnetic flux density as compared to a gradient between the magnetic field and the magnetic flux density under the condition of the peak current $I_{peak}$. As a result, the current changes at the valve opening finish timing increase, and thus it is possible to make the change in acceleration of the movable element 202 at the valve opening finish timing significantly easily detected as the maximum value of the second-order differential value of the voltage VL2. Similarly, there is an effect of enabling the changes of magnetic resistance caused by the decrease of the magnetic gap between the movable element 202 and the fixed core 107 after the valve body 214 starts to be displaced to be easily detected as the changes of the induced electromotive force using the current. In addition, the voltage to be applied after the voltage cutoff period $T_2$ may be set to 0 V. When the switching elements 805 and 807 are turned off after the end of the voltage cutoff period $T_2$ and the switching element 806 is turned on, the voltage of 0 V is applied to the solenoid 205. In this case, the current after the end of the voltage cutoff period T2 gradually decreases, and it is possible to detect the valve opening finish timing using the same principle as the condition that the battery voltage VB is applied. In addition, when power of a device, connected to the battery voltage, is turned on or off during the operation, the battery voltage VB changes at the moment, in some cases. In this case, the battery voltage VB may be monitored using the CPU 801 or the IC 802 to detect the valve opening finish timing of the fuel injection device of each cylinder under a condition that the change of the battery voltage VB is small. In addition, it is possible to stably detect the valve opening finish timing since there is no influence from the change of the battery voltage VB under the condition that 0 V is applied after the end of the voltage cutoff period $T_2$.

The above-described means for detecting the valve opening finish timing may be provided as the valve opening finish detecting unit, and the ECU 104 may have the function thereof. In addition, the valve opening start timing and the valve opening finish timing are strongly affected by the individual differences of the force caused by the load of the spring 210 acting on the valve body 214 and the movable element 202 and the fuel pressure and the magnetic suction force. At the timing when the magnetic suction force acting in the valve opening direction exceeds the sum of the load of the spring 210 acting in the valve closing direction and the force caused by the fuel pressure, the valve body 214 starts the valve opening and is affected by the individual differences of the respective forces even after starting the valve opening until reaching the valve opening finish timing. That is, an individual having a later valve opening start timing has a later valve opening finish timing, and an individual having an earlier the valve opening start timing has an earlier valve opening finish timing, and thus, a strong correlation is established between the valve opening finish timing and the valve opening start timing. Therefore, it is possible to estimate the valve opening start timing of each individual by multiplying the valve opening finish timing of each individual detected by the valve opening finish detecting unit included in the ECU 104 by a correction coefficient set in the register of the ECU 104 in advance. In addition, the force caused by the fuel pressure and acting on the valve body 214 increases when the fuel pressure increases, and thus, the valve opening start timing becomes late. A relationship between the fuel pressure and the valve opening start timing set in the register of the ECU 104 in advance, and thus, it is possible to estimate the valve opening start timing from the detection information at the finish of the valve opening even when the fuel pressure changes. In addition, if the force caused by the fuel pressure and acting the valve body 214 when the fuel pressure changes is affected by the individual difference, a value of the correction coefficient by which the valve opening finish timing is multiplied may be set in the register of the ECU as a MAP of the fuel pressure. It is possible to improve the accuracy of estimation of the valve opening start timing by changing the correction coefficient for each fuel pressure.

According to the valve opening start estimating unit described above, the valve operation until the valve body 214 reaches the maximum opening is stable, and it is possible to estimate the valve opening start timing of each individual of the fuel injection devices required for estimation of the injection quantity under the condition that the individual variations of the injection quantity have little influence on the air-fuel mixture, which contributes to combustion, and thus, it is possible to obtain both the combustion stability and the accuracy of the injection quantity estimation.

In addition, even in the configuration of the movable valve in which the valve body 214 and the movable element 202 are integrated, the detection of the valve opening finish timing can be performed based on the same principle as that used for detection of the valve opening finish timing described for a structure in which the valve body 214 and the movable element 202 are separate from each other.

Next, the second valve opening start estimating unit will be described with reference to FIG. 13. The ECU 104 or the drive circuit 103 is provided with the valve closing finish detecting unit which detects the valve closing finish timing by detecting changes of the induced electromotive voltage, caused by the operation of the movable element 202 under the condition of the intermediate opening, as changes of the inter-terminal voltage of the solenoid 205 and the valve opening start estimating unit which estimates the valve opening start timing from the detection information obtained in valve closing finish detection.

A description will be given regarding a principle of detecting the valve closing finish timing, which is performed in the valve closing finish detecting unit, and a detection method thereof with reference to FIG. 13. FIG. 13 is a diagram illustrating relationships among the displacement quantity of the valve body 114 of each of three individuals 1, 2 and 3, which have different valve closing operations of the valve body 214 due to variations of dimensional tolerance of the fuel injection devices 840, the inter-terminal voltage $V_{inj}$ of the solenoid 205, and a second-order differential value of the inter-terminal voltage $V_{inj}$ under the condition that the valve body 214 is driven at the intermediate opening. In addition, FIG. 14 is a diagram illustrating a correspondence among the magnetic gap x between the movable element 202 and the fixed core 207, the magnetic flux φ passing through a suction face of the movable element 202 with respect to the fixed core 207, and a terminal voltage of the solenoid 205.

From FIG. 13, when the injection pulse width Ti is turned off, the magnetic suction force having been generated in the movable element 202 decreases, and the valve body 214 starts the valve closing together with the movable element 202 at the timing when the magnetic suction force falls below forces in the valve closing direction acting on the valve body 214 and the movable element 202. The magnitude of the magnetic resistance of the magnetic circuit is inversely proportional to the cross-sectional area of a magnetic path in each path and the permeability, and proportional to a length of the magnetic path through which the magnetic flux passes. The permeability of the gap between the movable element 202 and the fixed core 207 is the permeability $\mu 0=4\pi\times 10-7$ [H/m] under the vacuum, and is extremely smaller than the permeability of the magnetic material, and thus, the magnetic resistance increases. Based on the relationship of $B=\mu H$, the permeability p of a magnetic material is determined by characteristics of the magnetization curve of the magnetic material and changes depending on the magnitude of an internal magnetic field of the magnetic circuit In general, a low magnetic field has a low permeability and has a profile that the permeability increases along with an increasing magnetic field and then decreases from a point in time of exceeding a certain magnetic field. When the valve body 214 starts the valve opening from the maximum displacement with the intermediate opening, the magnetic gap x between the movable element 202 and the fixed core 207 increases, and the magnetic resistance of the magnetic circuit increases. As a result, the magnetic flux that can be generated in the magnetic circuit decreases, and the magnetic flux that passes through between the movable element 202 and the fixed core 207 also decreases. If the magnetic flux generated inside the magnetic circuit of the solenoid 205 changes, an induced electromotive force according to the Lenz's law is generated. In general, the magnitude of the induced electromotive force in the magnetic circuit is proportional to the rate of change (first-order differential value of the magnetic flux) of the magnetic flux flowing in the magnetic circuit. When the number of windings of the solenoid 205 is N and the magnetic flux generated in the magnetic circuit is φ, the inter-terminal voltage V of the fuel injection device is represented by the sum of a term −Ndφ/dt of the induced electromotive force and a product of a resistance R of the solenoid 205 generated by the Ohm's law and a current i flowing to the solenoid 205 as expressed by Formula (1).

$$V = -N\frac{d\phi}{dt} + R \cdot i \tag{1}$$

When the valve body 214 comes into contact with the valve seat 218, the movable element 202 is separated from the valve body 114, the force in the valve closing direction caused by the load of the spring 210 having acted on the movable element 202 via the valve body 214 so far and the force caused by the fuel pressure acting on the valve body 214 does not act any more, and the movable element 202 receives a load of a zero position spring 212, which is a force in the valve opening direction.

A relationship between the gap x generated between the movable element 202 and the fixed core 207 and the magnetic flux φ passing through the suction face can be regarded as a relationship of the first-order approximation in an infinitesimal time. When the gap x increases, the distance between the movable element 202 and the fixed core 207 increases, the magnetic resistance increases, the magnetic flux that can pass through the end face of the movable element 202 on the fixed core 207 side decreases, and the magnetic suction force also decreases. In general, the suction force acting on the movable element 202 can be derived by Formula (2). From Formula (2), the suction force acting on the movable element 202 is proportional to the square of a magnetic flux density B on the suction face of the movable element 202, and proportional to a suction area S of the movable element 202.

$$F_{mag} = \frac{B^2 \cdot S}{2 \cdot \mu_0} \tag{2}$$

From Formula (1), there is a correspondence between the inter-terminal voltage $V_{inj}$ of the solenoid 205 and the first-order differential value of the magnetic flux φ passing through the suction face of the movable element 202. In addition, the area of a space between the movable element 202 and the fixed core 207 increases when the magnetic gap x increases, and thus, the magnetic resistance of the magnetic circuit increases, and the magnetic flux that can pass between the movable element 202 and the fixed core 207 decreases, and accordingly, it is possible to consider that the magnetic gap and the magnetic flux φ have the relationship of the first-order approximation in an infinitesimal time. The area of the space between the movable element 202 and the fixed core 207 is small under the condition that the magnetic gap x is small, and thus, the magnetic resistance of the magnetic circuit is small, and the magnetic flux that can pass through the suction face of the movable element 202 increases. On the other hand, the area of the space between the movable element 202 and the fixed core 207 is large under the condition that the gap x is large, and thus, the magnetic resistance of the magnetic circuit is large, and the magnetic flux that can pass through the suction face of the movable element 202 decreases. In addition, the first-order differential value of the magnetic flux has a correspondence with the first-order differential value of the gap x from FIG. 14. Further, the first-order differential value of the inter-terminal voltage $V_{inj}$ corresponds to the second-order differential value of the magnetic flux φ, and the second-order differential value of the magnetic flux φ corresponds to the second-order differential value of the gap x, that is, the acceleration of the movable element 202. Therefore, it is necessary to detect the second-order differential value of the inter-terminal voltage $V_{inj}$ in order to detect the change in acceleration of the movable element 202.

When the injection pulse width Ti is turned off, the step-up voltage VH in the negative direction is applied to the solenoid 205, and the current rapidly decreases like 1301. When the current reaches 0 A at a timing $t_{13a}$, the application of the step-up voltage VH in the negative direction is stopped, but a tail voltage 1302 is caused at the inter-terminal voltage due to the influence of the magnetic flux remaining in the magnetic circuit.

In addition, each valve closing finish timing of the valve body 214 of each of the individuals 1, 2 and 3 is set to $t_{13b}$, $t_{13c}$ and $t_{13d}$. As the movable element 202 is separated from the valve body 214 at the moment when the valve body 214 is in contact with the valve seat 218, the change of the force acting on the movable element 202 can be detected as the change in acceleration in the second-order differential value of the inter-terminal voltage $V_{inj}$. During the operation at the intermediate opening, the movable element 202 starts the valve closing operation in conjunction with the valve body 214 after the injection pulse width Ti is stopped, and the inter-terminal voltage $V_{inj}$ asymptotically approaches 0 V from a negative value. When the movable element 202 is separated from the valve body 214 after the closing of the valve body 214, the force in the valve closing direction, which has acted on the movable element 202 via the valve body 214 so far, that is, the force caused by the load of the spring 210 and the fuel pressure does not act any longer, and the load of the zero position spring 212 acts on the movable element 202 as the force in the valve opening direction. When the valve body 214 reaches the valve closing position and the direction of the force acting on the movable element 202 is changed from the valve closing direction to the valve opening direction, the second-order differential value of the inter-terminal voltage $V_{inj}$ having gradually increased so far starts to decrease. When the ECU 104 or the drive circuit 103 includes the above-described valve closing finish detecting unit that detects the maximum value of the second-order differential value of the inter-terminal voltage $V_{inj}$, it is possible to accurately detect the valve closing finish timing of the valve body 214. In addition, the change in acceleration of the movable element 202 is detected as a physical quantity in the method of detecting the valve closing finish timing using the second-order differential value of the inter-terminal voltage $V_{inj}$, and thus, it is possible to accurately detect the valve closing finish timing without being affected by changes in design values or tolerance and environment conditions such as current values. Although the description has been given in FIG. 13 regarding the case in which the valve body 214 is driven at the intermediate opening, the valve closing finish timing can be detected in the same manner as the method of FIG. 13 even when the valve closing is performed after the valve body 214 reaches the maximum opening. When the valve opening start timing is estimated from the valve closing finish timing, the detection information may be acquired, in advance, under an idling condition or the like where an operating condition of an engine is relatively stable.

When the valve opening finish detecting unit, the valve closing finish detecting unit, and the valve opening start estimating unit described above are provided, it is possible to estimate the valve opening start timing for each individual of the fuel injection devices, to detect the pressure at a suitably timing based on the information of the valve opening start timing, and to improve the accuracy of the injection quantity estimation.

Incidentally, the method that has been described in the first embodiment using FIG. 10 may be used for correction 33 of the injection quantity of each fuel injection device of each cylinder which is performed by the fuel injection quantity variation correcting unit. It is possible to perform the injection quantity correction, performed in the fuel injection quantity variation correcting unit, with high accuracy by improving the accuracy of the injection quantity estimation, to reduce the fuel injection quantity variations of each individual and to perform the accurate injection quantity control.

Next, a description will be given regarding a method of estimating the fuel injection quantity variation in the configuration of the valve opening start timing of each individual estimated by the valve opening start estimating unit, the valve opening finish timing detected by the valve closing finish detecting unit, the pressure signal acquiring unit, the injection time correcting unit, and the injection quantity correcting unit with reference to FIG. 15. FIG. 15 is a diagram illustrating relationships among the injection pulse, the valve body displacement quantity, pressure, and time when the valve opening start timing is aligned for each individual using the injection pulse Ti. The injection time estimating unit is a part of the software which is executed on the CPU 801. In addition, the injection time estimating unit has a function of obtaining a period (hereinafter, referred to as the injection time) during which the valve body 214 is opened, for each individual of the fuel injection devices, by subtracting the time between the turning-on of the injection pulse and the valve opening start timing from the time between the turning-on of the injection pulse and the valve closing finish timing which is detected or estimated using the valve closing finish detecting unit and the valve opening finish detecting unit. In addition, the pressure signal acquiring unit has a function of acquiring the pressure based on information of the injection time of each individual which is obtained by the injection time estimating unit. The injection quantity estimating unit is a part of the software which is executed on the CPU 801. In addition, the injection quantity estimating unit has a function of estimating the injection quantity of each individual based on the information of the injection time acquired using the information of the injection time.

The injection time during which the valve body 214 is opened is obtained by subtracting the time between the turning-on of the injection pulse and the valve opening start timing from the time between the turning-on of the injection pulse and the valve closing finish timing of the valve body 214. The time-series profile of the pressure, detected by the pressure sensor serving as the pressure detecting unit, has a correspondence with the time-series profile of the displacement of the valve body 214, and the pressure inside the fuel injection device 840 and the pressure inside the rail pipe 105 drop due to the fuel injection accompanying the start of the valve opening of the valve body 214, and changes of the fuel pressure appear along with the time lag. Therefore, it is possible to suitably determine a detection timing of the pressure to estimate the injection quantity if it is possible to detect the injection time of the valve body 214 using the drive device 150. The timing to detect the pressure may be determined using the injection time which is detected based on information on the valve opening start timing estimated using the valve opening start estimating unit and the valve closing finish timing detected using the valve closing finishing unit.

In addition, the timing to detect the pressure may be set to time corresponding to a half the injection time and a lag time set in the register of the ECU 104 in advance using the valve opening start timing detected by the valve opening start estimating unit as a start point. The valve opening start timing is set to the start point, and each timing after elapse of each half of each of the injection time of the individual 1501, the individual 1502, and the individual 1503 is set to $t_{15c}$, $t_{15d}$ and $t_{15e}$.

When the valve closing finishing unit, the valve opening finish detecting unit, the valve opening start estimating unit, the injection time estimating unit, and the pressure signal acquiring unit are provided, it is possible to detect the pressure after each of the timings $t_{15f}$, $t_{15g}$, and $t_{15h}$ at which the half the injection time of each individual has passed from the valve opening start timing of each individual as the start point. As a result, it is possible to detect the pressure near the timing when the pressure drop caused by the fuel injection of each individual is the largest, that is, the timing at which the pressure is the lowest. In addition, the injection quantity and the pressure have the correlation, and the pressure drop increases under the condition that the injection quantity increases, and the influence of the individual difference of the injection quantity is likely to appear in the pressure near the timing when the pressure drop is the largest. Therefore, it is easy to detect the fuel injection quantity variation caused by the individual difference of the nozzle sizes and the displacement quantity of the valve body 214 by detecting the pressure near the timing when the pressure drop is the largest. In addition, when the injection quantity estimating unit is provided, it is possible to estimate the injection quantity of each individual with high accuracy by detecting the pressure near the timing when the pressure drop is the largest using the ECU 104 via the A/D converter and multiplying the detection value thereof by the correction constant set in the register of the ECU 104 in advance.

Incidentally, the method that has been described in the first embodiment using FIG. 10 may be used for the correction of the injection quantity which is performed by the fuel injection quantity variation correcting unit. It is possible to perform the injection quantity correction, performed in the fuel injection quantity variation correcting unit, with high accuracy by estimating the injection quantity with high accuracy, to reduce the fuel injection quantity variations of each individual and to perform the accurate injection quantity control.

Third Embodiment

Next, a description will be given regarding an injection quantity estimation method according to a third embodiment with reference to FIGS. 9, 16 and 17. Incidentally, the fuel injection device 840, the ECU 104, and the drive device 103 in FIG. 16 have the same configurations as those of the first embodiment. In addition, the valve closing finish detecting unit, the valve opening finish detecting unit, the valve opening start estimating unit, the injection time estimating unit, and the pressure signal acquiring unit in FIG. 16 have the same configurations as those of the second embodiment. The injection time correcting unit and the fuel injection quantity variation correcting unit are each part of the software which is executed on the CPU 801. In addition, the injection time correcting unit has a function of adjusting any of the injection pulse Ti, the high voltage application time $T_p$, and the peak current $I_{Peak}$ for each individual so that the injection time acquired by the injection time estimating unit matches for each individual. The fuel injection quantity variation correcting unit, further, the fuel injection quantity variation correcting unit has a function of adjusting any of the injection pulse Ti, the high voltage application time $T_p$, and the peak current $I_{Peak}$ for each individual so that the fuel injection quantity variation of each individual decreases on the basis of the detection value of the pressure signal acquiring unit.

Figure 16:
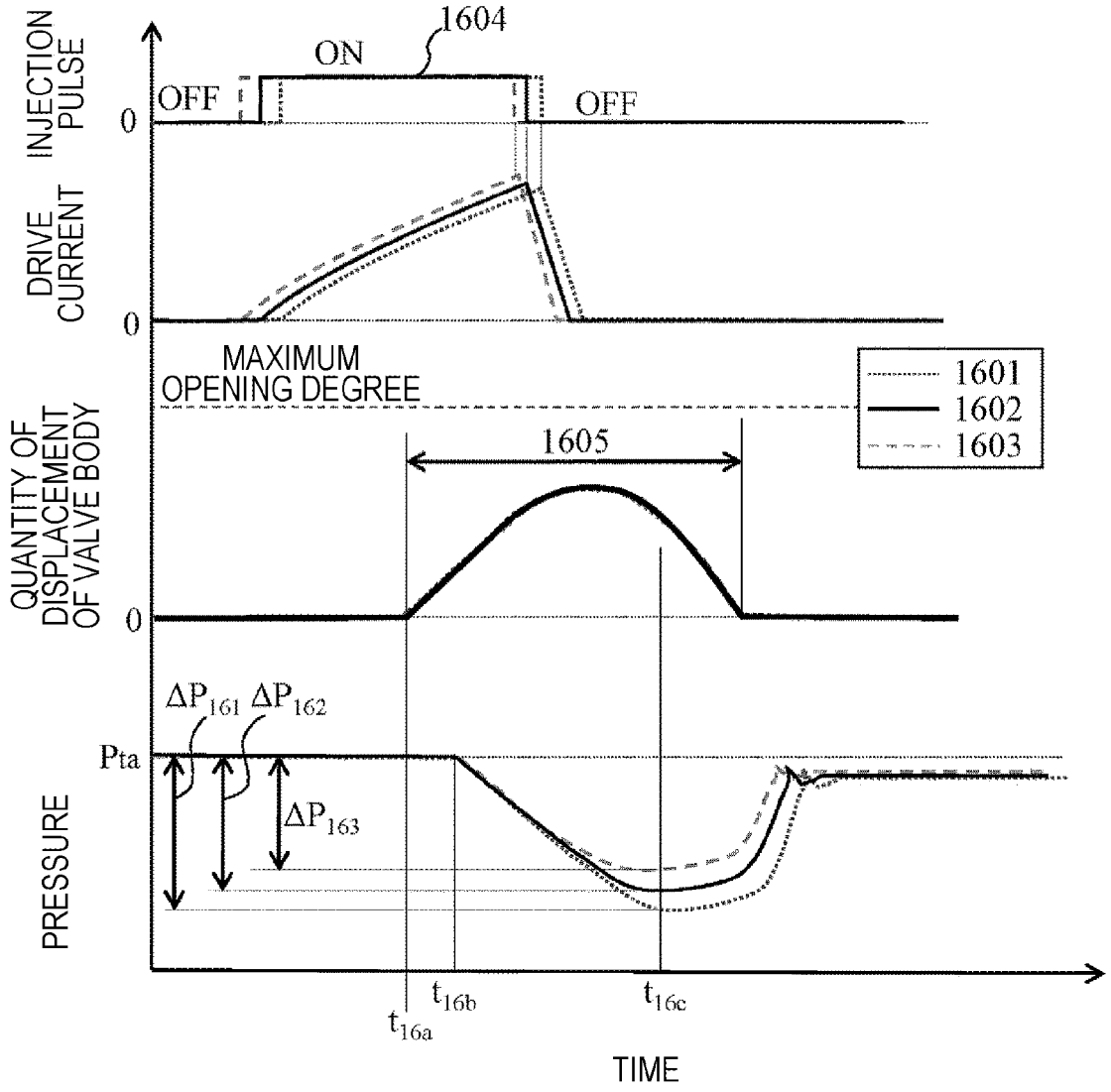
FIG. 16 is a diagram illustrating relationships among the injection pulse, the drive current, the valve body displacement quantity, the pressure detected by the pressure sensor, and time when each injection time of each valve body is aligned for each individual fuel injection device according to the third embodiment of the present invention.
Figure 17:
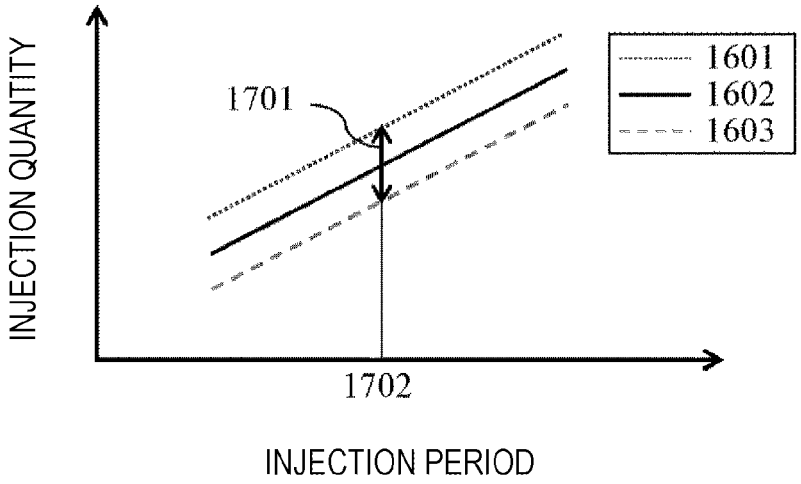
FIG. 17 is a diagram illustrating a relationship between each injection time of individual fuel injection devices and the injection quantity according to the third embodiment of the present invention.

FIG. 16 is a diagram illustrating relationships among the injection pulse, the drive current, the valve body displacement quantity, the pressure detected by the pressure sensor, and time when each valve opening time of the valve body 214 is aligned for each individual 1601, 1602 or 1603 of each fuel injection device according to the third embodiment.

The fuel injection quantity variation under the condition that the valve body 214 is driven at the intermediate opening is determined by two factors of the individual difference in the time-series profile of the displacement quantity of the valve body 214 and the individual difference caused by the nozzle dimensional tolerance such as the injection hole diameter. In the third embodiment, a two-step correction for reduction of fuel injection quantity variations of each individual is performed by correcting the fuel injection quantity variation caused by the individual difference in the time-series profile of the displacement quantity of the valve body 214 as a first step, and correcting the fuel injection quantity variation caused by the individual difference due to the nozzle dimensional tolerance as a second step.

First, a description will be given regarding a method of correcting the fuel injection quantity variation caused by the individual difference in the time-series profile of the displacement quantity of the valve body 214. The individual difference in the time-series profile of the displacement quantity of the valve body 214 is obtained as variations of the injection time obtained by subtracting the valve opening start timing from the valve closing finish timing of each of the individuals 1601, 1602 and 1603. The valve closing finish timing is detected by the valve closing finish detecting unit, and the valve opening start timing is estimated by the valve closing finish detecting unit or the valve opening finish detecting unit.

As illustrated in FIG. 9 in the first embodiment, when the same injection pulse width Ti is supplied to each individual of the fuel injection devices having the fuel injection quantity variations, the individual 901 having a large injection quantity has a long injection time, and the individual 903 having a small injection quantity has a short injection time. Any of the injection pulse width Ti, the high voltage application time Tp, and the peak current $I_{peak}$ may be adjusted for each individual so that each injection time of the individuals 901, 902 and 903 matches on the basis of the valve closing finish timing detected by the ECU, and the information of the estimation value of the valve opening start timing. The solenoid 205 is driven at high frequencies under a condition of high-rotation engine or a condition that injection of one combustion cycle is divided into a plurality of times of injection, and thus, there is a case in which the solenoid 205 generates heat and a resistance value of the solenoid 205 increases. When the resistance value increases, the current flowing to the solenoid 205 decreases. When the peak current $I_{peak}$ is used as a means for adjusting the injection time for each individual, the power consumption thereof is determined depending on a current value of the peak current $I_{Peak\ r}$ and thus, the peak current $I_{Peak}$ may be used in order to apply a table magnetic suction force during the valve opening operation. In addition, set resolution of the peak current $I_{peak}$ is determined by each accuracy of the resistors 808 and 813 for current detection, and thus, the minimum value of the resolution of $I_{peak}$ that can be set for the drive device 103 is restricted by the resistance of the drive device. On the other hand, when a timing to stop energization of the solenoid 105 is controlled using the high voltage application time $T_p$ and the injection pulse width Ti, each set resolution of the high voltage application time $T_p$ and the injection pulse width Ti is not restricted by the resistance of the drive device, but can be set in accordance with the clock frequency of the CPU 801, and thus, it is possible to decrease the time resolution as compared to the case of setting using the peak current $I_{peak}$. As a result, it is possible to determine the timing to stop energization of the solenoid 205 with high accuracy and to enhance the accuracy in correction of the injection time and the injection quantity of the fuel injection device of each cylinder. In addition, when the relationship between the injection time and the injection quantity and the relationship between the injection time and the injection pulse width are set in the register of the ECU in advance as a function, it is possible to determine the injection time and the injection pulse width Ti for each individual based on a requested value of a target injection quantity.

FIG. 16 is a diagram illustrating relationships among the injection pulse width, the drive current, the valve body displacement quantity, and the pressure when each injection time of the individuals 1601, 1602 and 1603 is adjusted for each individual to be like 1605 using the injection pulse width Ti and the timing when the injection pulse Ti is turned on is adjusted for each individual so that each valve opening start timing matches for each individual. In addition, FIG. 17 is a diagram illustrating a relationship between the injection time and the injection quantity when the injection time is changed for each individual using any means of the injection pulse Ti, the high voltage application time Tp, and the peak current $I_{Peak}$. Incidentally, each individual illustrated in FIG. 17 is the same as that of FIG. 16, and thus, is denoted by the same reference sign.

It is possible to reduce the individual differences of the injection time by adjusting any of the injection pulse Ti, the high voltage application time $T_p$, and the peak current $I_{Peak}$ for each individual using the valve opening finish detecting unit, the valve closing finish detecting unit, the valve opening start estimating unit, and the injection time the detection unit so that each injection time of each individual matches, and it is possible to reduce the fuel injection quantity variation caused by the individual difference of the displacement quantity of the valve body 214. In addition, when the high voltage application time $T_p$ or the peak current $I_{peak}$ is used as the means for adjusting the injection time for each individual, the step-up voltage VH or 0 V in the negative direction may be applied to the solenoid 205 after the end of the high voltage application time $T_p$ and the arrival at the peak current $I_{peak}$ to cause the shift to a holding current. It is possible to reduce the individual differences of the displacement quantity of the valve body 214 caused when the magnetic suction force acting on the valve body 214 or the movable element 202, the load of the spring 210, the force due to the fuel pressure, and the like are changed among individuals by adjusting the injection time for each individual using the high voltage application time $T_p$ or the peak current $I_{Peak}$. In addition, it is possible to decrease the influence of the individual difference of the force acting on the valve body 214 or the movable element 202 on the displacement quantity of the valve body 214 by adjusting the injection time for each individual, and thus, it is possible to control the variations of the injection time even when the same energization time is set to the individuals under the condition that the injection pulse width is longer than the time until reaching the peak current $I_{Peak}$ from the timing when the injection pulse is turned on, as the start point, or the high voltage application time $T_p$. As a result, there is an effect of enabling reduction of the fuel injection quantity variations caused by the individual differences of the displacement quantity of the valve body 214.

On the other hand, when there are individual differences caused by the nozzle dimensional tolerance such as the injection hole diameter, the fuel injection quantity variations, which are hardly corrected by the adjustment of the injection time for each individual, remain even if the injection time matches for each individual. In the time-series profile of the pressure after matching the injection time, a valve opening start timing $t_{16a}$ matches each other, and thus, a timing $t_{16b}$ when the pressure decreases substantially matches among the individual. However, the time-series profiles of the pressure after the timing $t_{16b}$ have variations among the individuals due to the influence of the fuel injection quantity variations caused by the nozzle dimensional tolerance such as the injection hole diameter. From the relationship between the injection time and the injection quantity illustrated in FIG. 17, an injection time 1703 corresponds to the injection time 1605 in FIG. 16. A fuel injection quantity variation 1703 remaining after the alignment of the injection time corresponds to the fuel injection quantity variation caused by the nozzle dimensional tolerance.

Next, a description will be given regarding a method of correcting the fuel injection quantity variation caused by the nozzle dimensional tolerance in the second step. After the matching of the injection time among the respective individuals, the pressure at a predetermined timing $t_{16f}$ is detected for each individual using the pressure detecting unit. Incidentally, the same method as described in FIGS. 9, 11 and 15 may be used as a method of determining the timing to detect the pressure. The individual difference of the pressure, detected under the condition where the injection time has been adjusted for each individual, corresponds to detection of the individual difference of the injection quantity caused by the nozzle dimensional tolerance, and there is a strong correlation between the pressure and the injection quantity. Therefore, it is possible to estimate the injection quantity of each individual with high accuracy by aligning the injection time, then detecting the pressure at the predetermined timing, and multiplying the pressure by the correction constant set in the register of the ECU 104 in advance. In addition, the estimation of the injection quantity may be performed under two or more conditions having different injection pulse widths. A first one is the condition that the injection time is adjusted for each individual. In addition, a second one is the condition with a larger injection pulse width than that in the condition where the injection time is adjusted for each individual. It is possible to obtain coefficients of a relational expression between the injection time and an estimation value of the injection quantity, set in the register of the ECU 104 in advance, for each individual by performing estimation of the injection quantity under the two conditions having the different injection pulse widths. As a result, it is possible to accurately estimate the injection quantity even when the injection pulse Ti changes and the injection time changes among the individuals. Next, a description will be given regarding the injection quantity correction method which is performed in the fuel injection quantity variation correcting unit. After aligning the injection time for each individual, any of the injection pulse Ti, the high voltage application time $T_p$ and the peak current $I_{Peak}$ may be adjusted for each individual so that each pressure or estimation value of the injection quantity matches for each individual. When the valve closing finish detecting unit, the valve opening finish detecting unit, the valve opening start estimating unit, the injection time estimating unit, the pressure signal acquiring unit, the injection time estimating unit, the injection time correcting unit, and the fuel injection quantity variation correcting unit are provided, it is possible to correct the injection quantity of each individual with high accuracy and to accurately control the minute injection quantity.

REFERENCE SIGNS LIST

101A, 101B, 101C, 101D fuel injection device
102 pressure sensor
103 drive circuit
104 ECU (engine control unit)
105 rail pipe
106 fuel pump
107 combustion chamber
150 drive device
201 nozzle holder
202 movable element
203 housing
204 bobbin
205 solenoid
207 fixed core
210 spring
211 magnetic throttle
212 return spring
215 rod guide
214 valve body
216 orifice cup
218 valve seat
219 fuel injection hole
224 spring clamp
301 air gap
202 end face
210 contact face
840 fuel injection device
801 central processing unit (CPU)
802 IC
830 solenoid
815 ground potential (GND)
841 terminal of solenoid on ground potential (GND) side
Ti injection pulse width (valve opening signal time)
$T_p$ high voltage application time (Tp)
$T_2$ voltage cutoff time (T2)
VH step-up voltage
VB battery voltage
$I_{Peak}$ peak current
Ih holding current value

The invention claimed is:

1. A drive device for fuel injection devices, the drive device comprising:

a drive circuit that controls current to a solenoid of each of a plurality of fuel injectors of an engine, wherein the solenoid of each of the plurality of fuel injectors, in response to the current, drives a movable core connected to a valve element of a respective fuel injector to open/close a respective fuel flow path from a fuel supply pipe to the respective fuel injector in order to inject predetermined quantities of fuel;

a pressure sensor that is attached to the fuel supply pipe disposed upstream of a particular fuel injector from the plurality of fuel injectors;

a drive sensor that acquires information about the engine; and an Engine Control Unit (ECU) that is communicatively coupled to the drive circuit, the drive sensor and the pressure sensor, wherein the ECU is configured to:

determine a predetermined timing after opening of the respective fuel flow path of the particular fuel injector based on the information about the engine acquired by the drive sensor, acquire, from the pressure sensor, a pressure detection value at the predetermined timing after opening of the respective fuel flow path of the particular fuel injector, correct an energization time or an energization current to form corrected values based on the pressure detection value, and control, using the drive circuit, the particular fuel injector according to the corrected values.

2. The drive device for fuel injection valve according to claim 1, wherein the drive sensor is a crank angle sensor that detects an angle of a crankshaft of the engine.

* * * * *